US007431470B2

(12) United States Patent
Coleiro

(10) Patent No.: US 7,431,470 B2
(45) Date of Patent: Oct. 7, 2008

(54) TRANS-MEMBRANE SOLAR ENERGY LIGHTING DEVICE

(76) Inventor: Lenard C. Coleiro, 1673 Sharon Drive, London, Ontario (CA) N0L 1R0

( * ) Notice: Subject to any disclaimer, the term of this patent is extended or adjusted under 35 U.S.C. 154(b) by 135 days.

(21) Appl. No.: 11/347,571

(22) Filed: Feb. 6, 2006

(65) Prior Publication Data

US 2006/0207637 A1 Sep. 21, 2006

Related U.S. Application Data

(60) Provisional application No. 60/649,558, filed on Feb. 4, 2005.

(51) Int. Cl.
*A45B 23/00* (2006.01)

(52) U.S. Cl. ..... 362/102

(58) Field of Classification Search ..... 362/102, 362/183; 135/16

See application file for complete search history.

(56) References Cited

U.S. PATENT DOCUMENTS

| | | | | |
|---|---|---|---|---|
| 2,087,537 | A | 7/1937 | Finkle | |
| 3,313,929 | A | 4/1967 | Schiavano | |
| 3,801,809 | A | 4/1974 | Slade | |
| 3,870,062 | A | 3/1975 | Medlin | |
| 4,174,532 | A | 11/1979 | Kelly | |
| 4,408,260 | A | 10/1983 | Miedel | |
| 4,425,602 | A | 1/1984 | Lansing | |
| 5,053,931 | A | 10/1991 | Rushing | |
| 5,126,922 | A | 6/1992 | Andreasen et al. | |
| 5,584,564 | A | 12/1996 | Phyle et al. | |
| 5,769,000 | A | 6/1998 | Dunfey | |
| 5,911,493 | A | 6/1999 | Walker et al. | |
| 6,126,293 | A | 10/2000 | Wu | |
| 6,340,233 | B1 | 1/2002 | Shieh | |
| 6,382,809 | B1 | 5/2002 | Ou-Yang | |
| 6,439,249 | B1 | 8/2002 | Pan | |
| 6,499,856 | B2 | 12/2002 | Lee et al. | |
| 6,598,990 | B2 | 7/2003 | Li | |
| 6,612,713 | B1 * | 9/2003 | Kuelbs | 362/102 |
| 6,659,616 | B1 | 12/2003 | Bilotti | |
| 6,666,224 | B2 | 12/2003 | Lee | |
| 6,692,135 | B2 | 2/2004 | Li | |
| 6,773,140 | B2 | 8/2004 | Lee | |
| 7,013,903 | B2 | 3/2006 | Li | |
| 7,134,762 | B2 * | 11/2006 | Ma | 362/102 |
| 7,249,863 | B2 * | 7/2007 | Ballarini et al. | 362/121 |
| 2002/0070427 | A1 | 6/2002 | Maidment | |
| 2002/0176247 | A1 | 11/2002 | Lee | |
| 2003/0000557 | A1 | 1/2003 | Lai | |

(Continued)

*Primary Examiner*—Sandra O'Shea
*Assistant Examiner*—James W Cranson

(57) ABSTRACT

Radiant-energy-powered lighting devices, and particularly those which are adapted and arranged to gather solar energy, are provided. Devices of the invention are particularly suitable for use on one side of a membrane, such as fabric membrane, to provide electrical power or visible light on the same, or on an opposing side, of that same membrane, or at a distance from where the radiant energy is gathered. Devices and methods of the present invention are particularly useful with apparatus made of thin materials such as fabric or fabric-like membranes, such as umbrellas, tents, awnings, and tent-like structures such as temporary shelters and inflatable structures formed of membranes. Embodiments of the present invention are also adaptable for use with other thin materials, such as metallic, glass or wooden sheets or panels, and are thus adaptable for use with vehicles and habitable structures.

20 Claims, 31 Drawing Sheets

U.S. PATENT DOCUMENTS

2003/0067765 A1 4/2003 Li
2003/0084931 A1 5/2003 Lee
2003/0179576 A1 9/2003 Huang
2003/0230331 A1 12/2003 Li
2004/0031510 A1 2/2004 Li
2004/0031513 A1 2/2004 Bunch
2004/0095749 A1 5/2004 Bilotti
2004/0100791 A1 5/2004 Bilotti
2004/0149325 A1 8/2004 Kuelbs
2004/0228118 A1 11/2004 Peterson
2005/0005962 A1 1/2005 Clifton et al.

* cited by examiner

TRANS-MEMBRANE SOLAR ENERGY LIGHTING DEVICE

REFERENCE TO RELATED APPLICATIONS

The present application claims priority to U.S. Provisional Application Ser. No. 60/649,558, filed Feb. 4, 2005, which is incorporated herein by reference in its entirety.

FIELD OF THE INVENTION

The present invention pertains to radiant-energy-powered lighting devices, and particularly those which are adapted and arranged to gather energy, such as solar energy, on one side of a membrane, such as a fabric membrane, and provide electrical power or visible light on the same, or on an opposing side, of that same membrane, or at a distance from where the radiant energy is gathered.

Devices and methods of the present invention are particularly useful with apparatus made of thin materials such as fabric or fabric-like membranes, such as umbrellas, tents, awnings, and tent-like structures such as temporary shelters and inflatable structures formed of membranes. Embodiments of the present invention are also adaptable for use with other thin materials, such as metallic, glass or wooden sheets or panels, and are thus adaptable for use with vehicles and habitable structures.

BACKGROUND OF THE INVENTION

With the increasing costs of energy, means and methods for harvesting energy from abundant sources, such as radiant energy from the sun or other sources, have become significant as potential ways of providing electrical power for lighting and other uses. Such other uses include, for example, the powering of hot water heaters, radios, and emergency communications equipment, for example, in vehicles. Specific needs for such radiant-energy-gathering devices include those wherein a garden umbrella, which is typically used for shade during daylight hours, is provided with solar light gathering means for gathering sunlight during daylight hours, Devices according to the invention, such as solar-powered lighting assemblies, comprise two main components that operatively communicate with one another through, or across, a membrane. In the context of the invention, a membrane is any thin material. In one aspect, the thin material can be fabric or flexibly fabric-like, such as the natural or synthetic fabric of a patio umbrella or tarp, the natural or synthetic fabric of the roof or wall of a tent, or the natural or synthetic fabric of a vehicle convertible roof. In another aspect, the thin material can be more rigid, such as thin wood or the metallic roof of a vehicle so long as an aperture, conduit, inductive bridge, or other means for permitting operative communication between the two main components is provided.

Within the scope of the concept of the invention, many embodiments of the invention can be comprehended. Key elements may include at least one circuit board, switching means, one or more rechargeable batteries, or one or more fuel cells, capacitive storage devices, or the like, housing structures for housing various elements of the invention such as the circuit boards and batteries, one or more magnets, such as rare earth magnets, employable for operatively juxtaposing the two main (housing) components of the invention with respect to one another, and one or a plurality of electrically conductive pins for transmitting electricity from a means for converting radiant energy to electricity, such as a solar cell, to a source of light of a desired frequency range, such as an LED. In some preferred embodiments, the light source, such as an LED bulb, can be enclosed in a translucent, transparent or reflective fixture which is connected by means of a thin electrically conductive cable to, for example, a circuit board in one or both of the plastic housings. The conductive cable may serve also to suspend a lighting fixture from a lower main housing structure of the invention to provide desired light dispersion or delivery. Alternately the light source can be covered by a translucent or transparent lens.

In general, the main outer, or upper, component comprises means for converting radiant energy, such as solar energy, to electricity. One means of converting solar energy to electricity is at least one solar panel which is preferably operatively connected to a light sensor, which is in turn operatively connected to a plurality of pins, which provide operative connections to corresponding sockets in the lower component and in turn provide one or more means for storing the electrical energy, such as one or more rechargeable batteries.

The outer (upper) main component, is held in place in close proximity to the inner (lower) main component by any means adaptable to the specific use of the embodiment, for example, by a rare earth magnet or by screws where a more permanent installation is desired. The device may be constructed and arranged so that one of the main components can be positioned partially surrounding one of the struts of the umbrella and the other main component is on the corresponding outer position of that strut. Such positioning ensures that the solar panel is not covered by the folds of umbrella fabric when the umbrella is closed. A light sensor can be adapted and arranged to ensure that the lamp only comes on when it is dark. Advantageously, a tilt switch may be provided and positioned so that the lamp will turn off when the umbrella is lowered and turn on when the umbrella is erect. A three position switch can be used to override the tilt switch allowing the LED bulb to be on, off, or auto (tilt switch enabled).

A transparent, translucent or reflective fixture, which houses the LED bulb, may hang from a short cable and is small enough to allow the umbrella to be completely closed without obstruction. Since the two main components may attach through the fabric membrane of the umbrella, there are no exposed cables to be tangled when raising and lowering the umbrella. The solar panel may thus continue to charge the batteries whether the umbrella is raised or lowered. It is therefore clear that the elements of the invention can be combined in numerous ways to provide a plethora of combinations and embodiments. It is also clear that there is a need for devices and methods for effectuating the efficient gathering and usage of radiant energy, such as solar energy

SUMMARY AND OBJECTS OF THE INVENTION

It is therefore an object of the present invention to provide radiant-energy-powered lighting devices which can be operated at low cost.

It is another object of the present invention to provide such devices in embodiments constructed and arranged to be disposed across a membrane, such as that of an umbrella, tent, awning, vehicle roof or temporary shelter.

It is a further object of the invention to provide means and methods for gathering radiant energy and transmitting that energy to storage means or across a membrane to utilization means.

In accordance with these and other objects, a device for providing illumination is provided. In one preferred embodiment, the device comprises at least one means for gathering radiant energy, wherein the means for gathering radiant energy is constructed and arranged for receiving the radiant energy and to be disposable on or adjacent to a first side of a membrane; at least one means for converting the radiant energy into electrical power; at least one means for transmitting the electrical power across the membrane; and at least one means for producing light of a desired frequency range from the electrical power; wherein the means for producing light of a desired frequency range is constructed and arranged to be disposable on, adjacent to, or near a second side of the membrane, wherein the second side is disposed opposite the first side of the membrane. In some preferred embodiments, the device further comprises at least one means for storing the electrical power.

Apparatus of the invention can be constructed and arranged to convert radiant energy of many types, or frequencies, to electricity for use by the means for producing light portion of the devices. As examples, radiant energy suitable for conversion to electricity by the invention are one or more of solar energy, reflected solar energy, any portion of the solar radiation spectrum, thermal energy, and radiant energy produced by artificial means, such as the radiant energy produced by incandescent light bulbs, infrared heat sources, and by any other type of radiant energy.

In some preferred embodiments of the invention, the means for converting the solar energy into electrical power is one or more solar panels, preferably wherein the solar panels comprise solar cells. Advantageously, the present invention comprehends any means or method for transmitting electrical energy across a membrane to the light-producing source. Thus, as examples, the means for transmitting electrical power across the membrane may be one or more selected from the group comprising magnetic inductors, electrical inductors, electrically conductive pins constructed and arranged for piercing the membrane and extending between the means for receiving solar energy and the means for producing light, wiring means such as wiring harnesses comprising one or more wires or cables, and wiring means constructed and arranged for piercing the membrane and extending between the means for receiving solar energy and the means for producing light.

In accordance with additional objects of the invention, one or more means for producing light of a desired frequency range from electrical power are provided on a side of the membrane opposite that of the means for gathering radiant energy. Preferably the one or more means for producing light of a desired frequency range from the electrical power is one or more selected from the group comprising incandescent light bulbs, light-emitting diodes (LED's), organic light-emitting diodes (OLED's), electro-luminescent devices and fluorescent devices.

Means for gathering radiant energy according to the invention include any which perform to a desired level in the context of the use of a particular embodiment. Among the preferred means for gathering the radiant energy are one or more selected from the group comprising solar cells, solar panels, lenses, reflectors, mirrors, prisms and combinations thereof.

Similarly, means for storing electrical energy according to the invention include any which perform to a desired level in the context of the use of a particular embodiment. Thus, preferred means for storing the electrical energy is one or more selected from the group comprising batteries, rechargeable batteries, capacitors, other capacitive storage devices, electronic chips, NiCad Batteries, Nickel-Metal Hydride (NiMH) batteries, Lithium-ion (Li-ion) batteries, Zinc-Air fuel cells and other types of fuel cells. As an additional advantage of devices of the invention, they preferably comprise circuitry for controlling the supply of the electrical power to the means for producing light, and for controlling the supply of the electrical power to the means for storing the electrical energy.

A membrane according to the invention is any essentially two-sided layer or structure across which it is desired to transmit electricity from a means for generating electricity on the first side of the membrane for the purpose of energizing a light source located on the second side of the membrane. Thus, a membrane of the invention may comprise, for example, one or more layers of fabric formed of natural fibers, one or more layers of fabric formed of synthetic fibers, one or more layers of fabric formed of a combination of synthetic and natural fibers, one or more layers of plastic sheeting, one or more layers of other synthetic materials, one or more layers of glass, one or more layers of metallic sheeting, one or more layers of wood, one or more layers of building materials, or one or more layers of roofing.

Moreover, in the context of the present invention, a membrane of the invention may comprise at least part of a structure, that structure can be one or more of, for example, a tent, an umbrella, a shelter, a tarp, a canopy, an awning, a building, a window, a fabric or fiberglass vehicle portion, a vehicle roof, and other vehicle portions comprising metallic, natural or synthetic materials. As yet another advantage, the invention includes combinations of the means for gathering radiant energy and converting such energy into electricity, along with means for producing light of desired frequencies, in combination with numerous structures. Such structures include at least a portion of one or more of a tent, an umbrella, a shelter, a tarp, a canopy, an awning, a fabric or fiberglass vehicle portion, a window, a vehicle roof, and other vehicle portions comprising metallic, natural or synthetic materials.

Apparatus according to the invention preferably further comprises switch means operatively connected to one or more of the means for gathering radiant energy, the means for producing light and the means for storing the electrical energy, wherein the switch means is constructed and arranged to activate and deactivate the one or more means for gathering radiant energy, the means for producing light and the means for storing the electrical energy. Thus, the functions of gathering radiant energy, converting it into electricity, transmitting the electricity across the membrane and operating the light-producing means can be controlled by means of one or more switches. Moreover, the one or more switch means may be constructed and arranged to be operated remotely. The switch means may also be constructed and arranged to be operated in conjunction with a radiant energy sensor, such as any sensor associated with the device to optimize its functions. As one example, a solar sensor may be provided which operates a switch controlling electrical power to the light producing means.

Moreover, in accordance with related advantages, one or more of the means for gathering radiant energy, the means for transmitting the electrical power, and the means for producing light may be constructed and arranged to be reversibly attachable onto or adjacent to the membrane, or onto or adjacent a structure to which the membrane is attached. For example, a device according to the invention may include an umbrella provided with means for receiving the radiant energy disposed on or adjacent to a first side of the fabric of the umbrella, at least one means for converting the radiant energy into electrical power, at least one means for transmitting the electrical power across the fabric, and at least one means for producing light of a desired frequency range from the electrical power. Preferably, one or more of the means for gathering radiant energy, the means for producing light, the means for storing the electrical energy and the means for transmitting the electrical power across the membrane, are constructed and arranged such that the fabric membrane of the umbrella is capable of being folded, rolled or otherwise manipulated without rendering the device inoperable.

In embodiments, where the device includes an umbrella, the umbrella may be constructed and arranged to have a number of extended and folded configurations, and may further comprise a tilt switch. Preferably, the tilt switch is constructed and arranged such that one or more of the means for gathering radiant energy, the means for transmitting the electrical power across the membrane, the means for producing light, and the means for storing the electrical energy are activated by one or more of the umbrella configurations. Preferably, the means for gathering radiant energy, such as a solar cell, is disposed upon the umbrella such that the radiant energy reaches the device regardless of which of the multiple configurations in which the umbrella is disposed.

In accordance with still other objects, methods for gathering radiant energy, such as solar energy, for example, to be used to provide illumination, or to be stored for other purposes, are provided. In one preferred embodiment of methods of the invention, a method comprises the steps of providing at least one means for gathering radiant energy, wherein the means for gathering radiant energy is constructed and arranged for receiving the radiant energy and to be disposable on or adjacent to a first side of a membrane; providing at least one means for converting the radiant energy into electrical power; providing at least one means for transmitting the electrical power across the membrane. As further one or more optional steps, the method may comprise the steps of providing at least one means for storing the gathered radiant energy as electricity, providing at least one means for producing light of a desired frequency range from the electrical power; wherein the means for producing light of a desired frequency range is constructed and arranged to be disposable on, adjacent to, or near a second side of the membrane, wherein the second side is disposed opposite the first side of the membrane. In some preferred embodiments, the methods further comprise the step of providing electrical circuitry means for one or more of storing, routing and selectively using the electrical power.

BRIEF DESCRIPTIONS OF THE FIGURES

FIG. 1 is an upper oblique view of an embodiment of the invention adapted for use with a framed membrane or fabric structure, such as an umbrella, with the upper and lower housing separated and depicting radiant-energy gathering and illumination fixture 135 according to the invention;

FIG. 2 is an upper oblique exploded view of the device of FIG. 1 depicting some key contents of lower housing 159, including rechargeable batteries 115, circuit board 111 and tilt switch 113;

FIG. 3 is a lower oblique view of the embodiment of FIG. 1. showing metal plate 121 and three-position switch 139;

FIG. 4 shows lower housing 159 of device 135 of FIG. 1, installed over a strut of an umbrella, beneath umbrella fabric 175, and supporting translucent illumination element 133;

Figure 1:
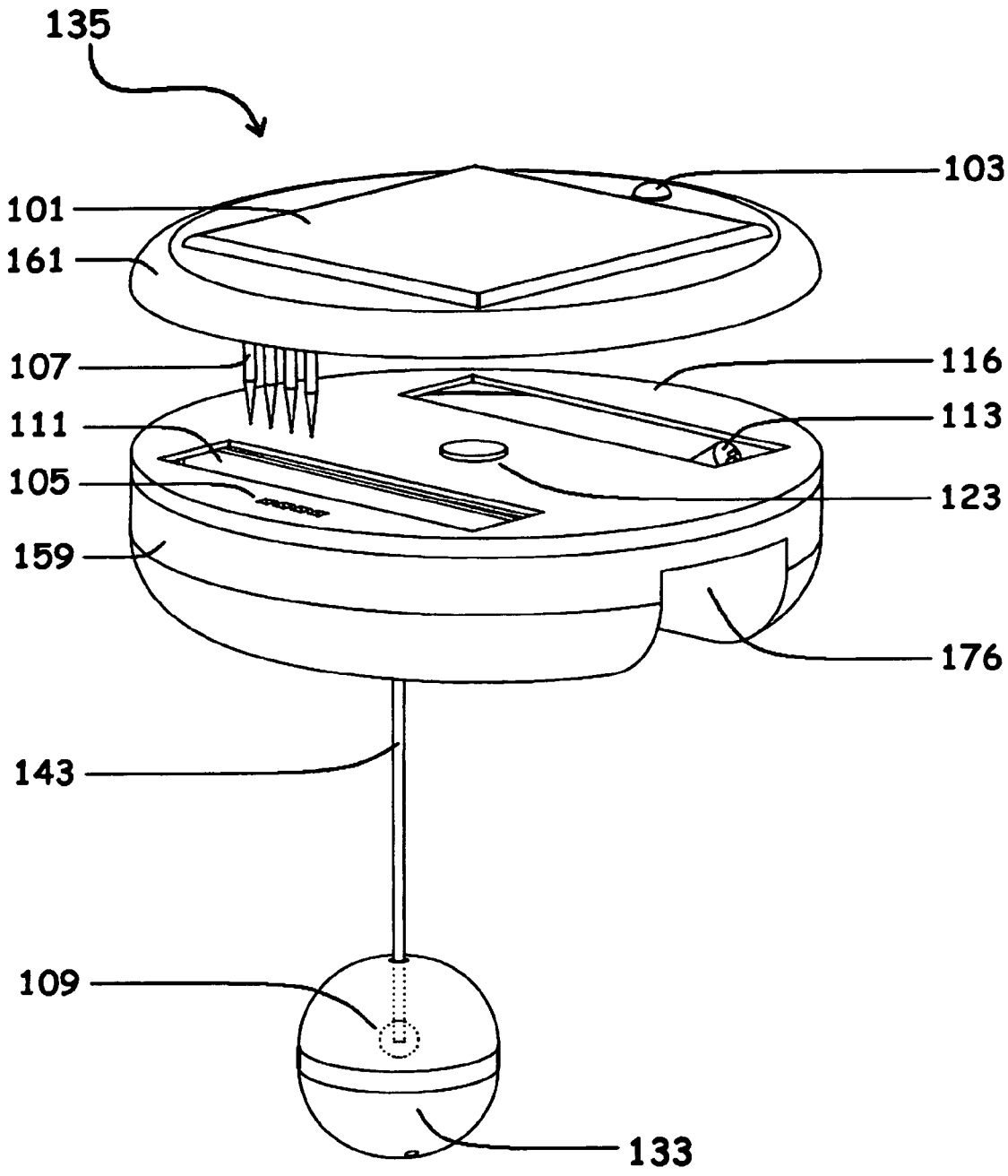
Figure 7:
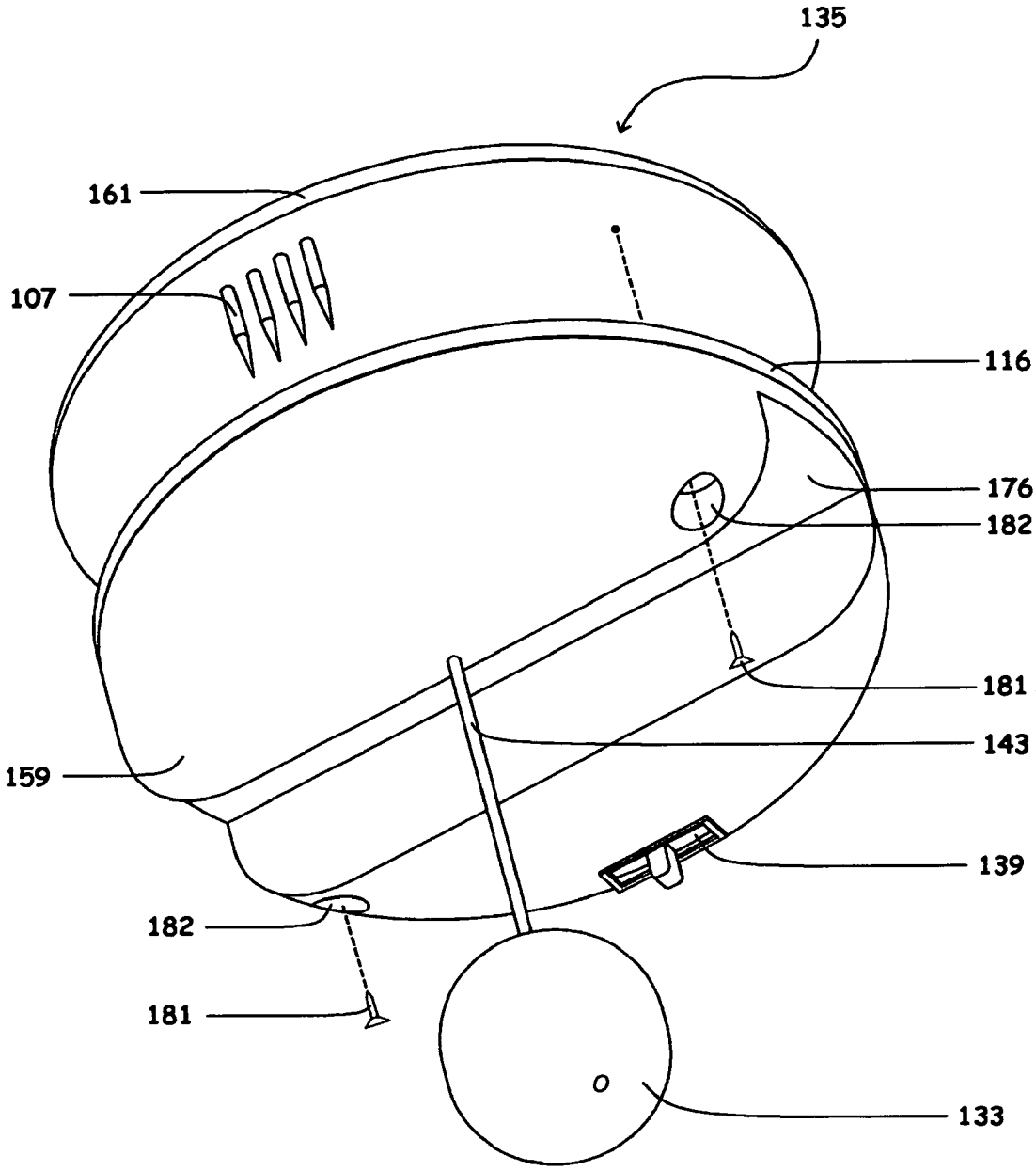
Figure 8:
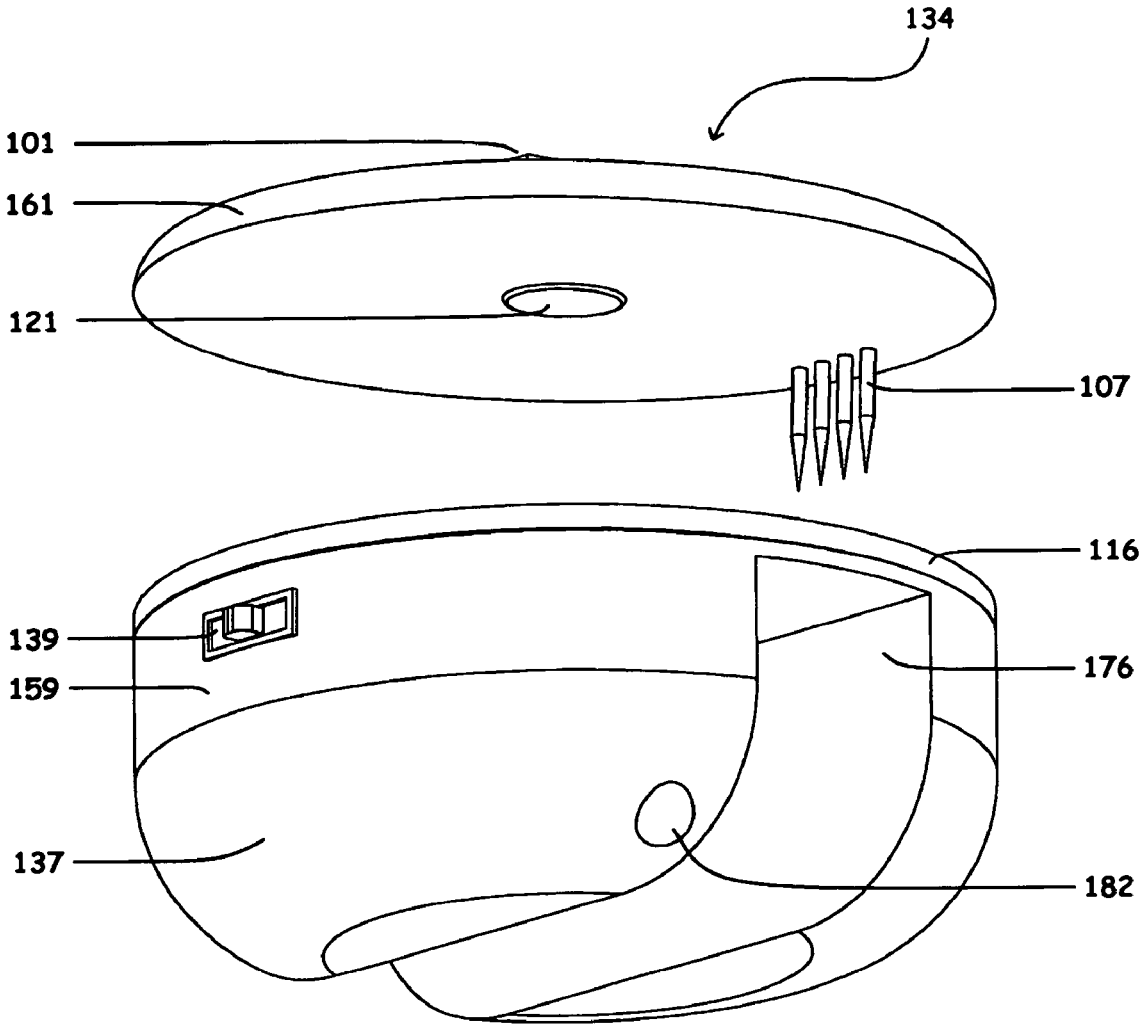
Figure 9:
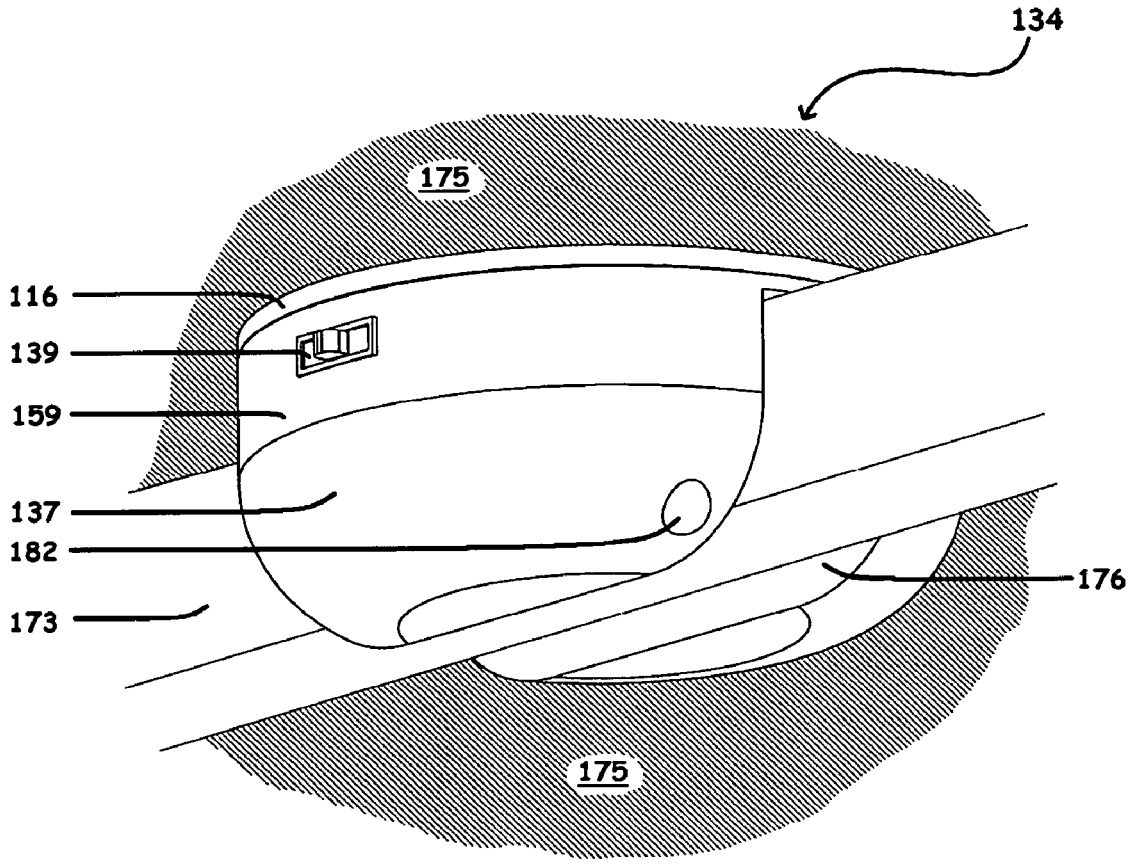
Figure 10:
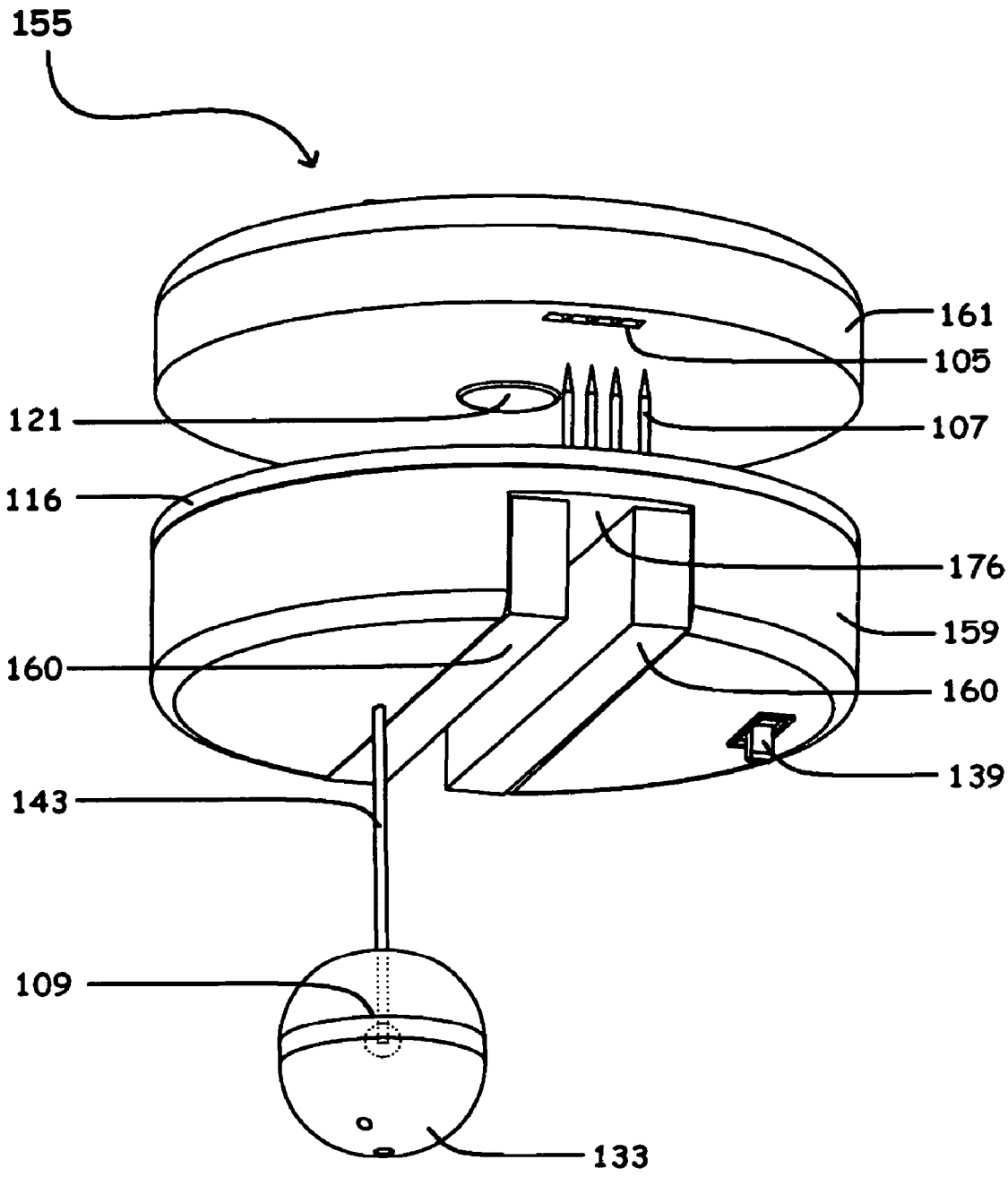
Figure 11:
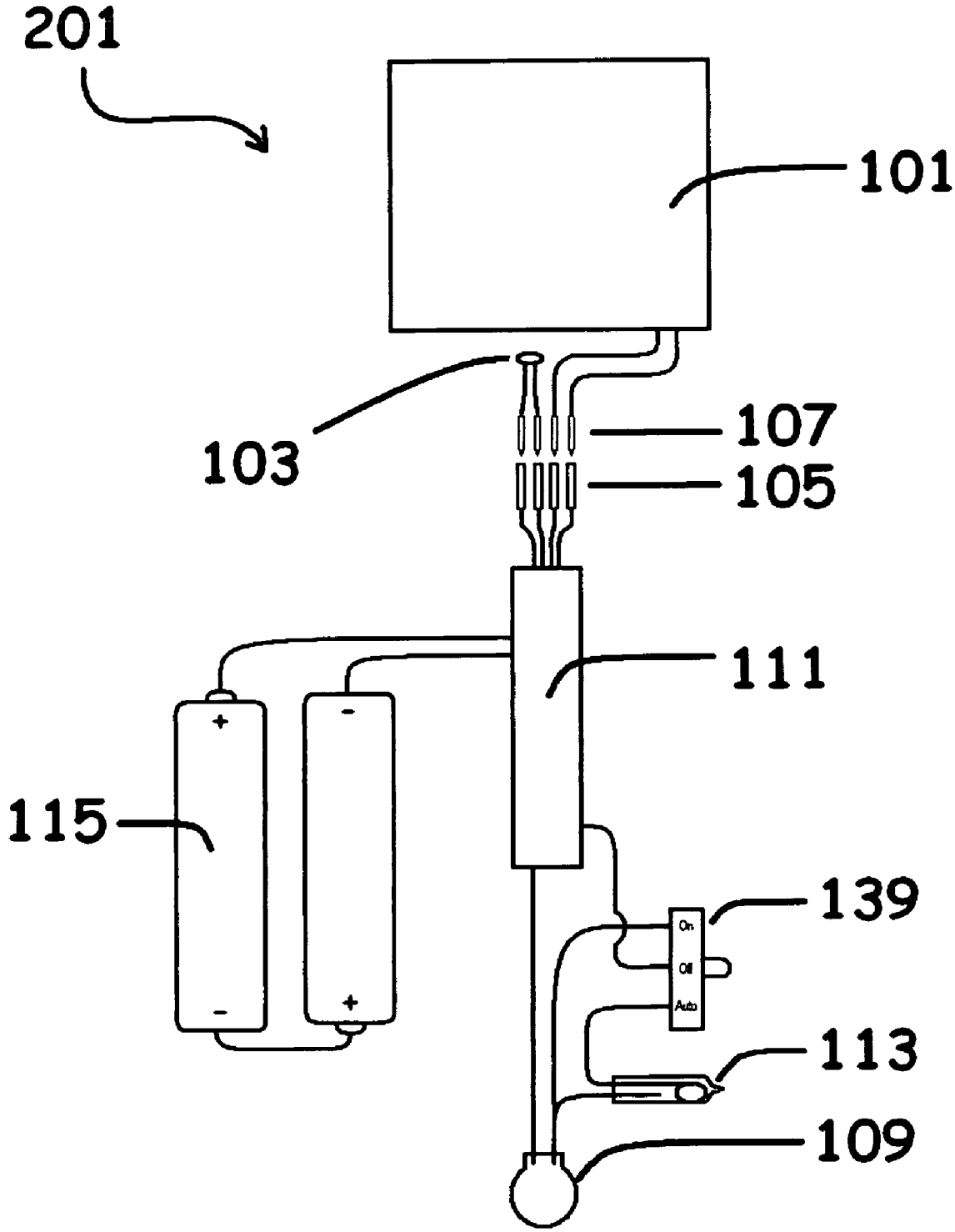
Figure 12:
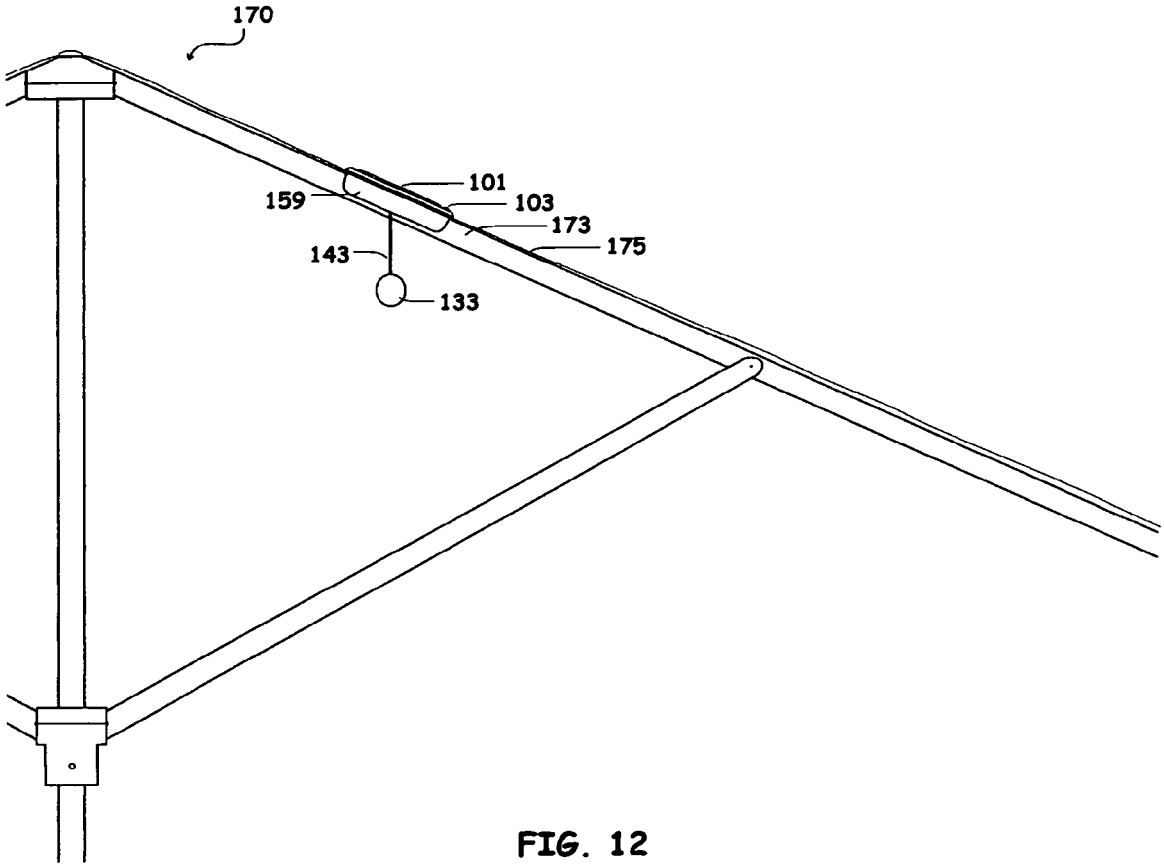
Figure 13:
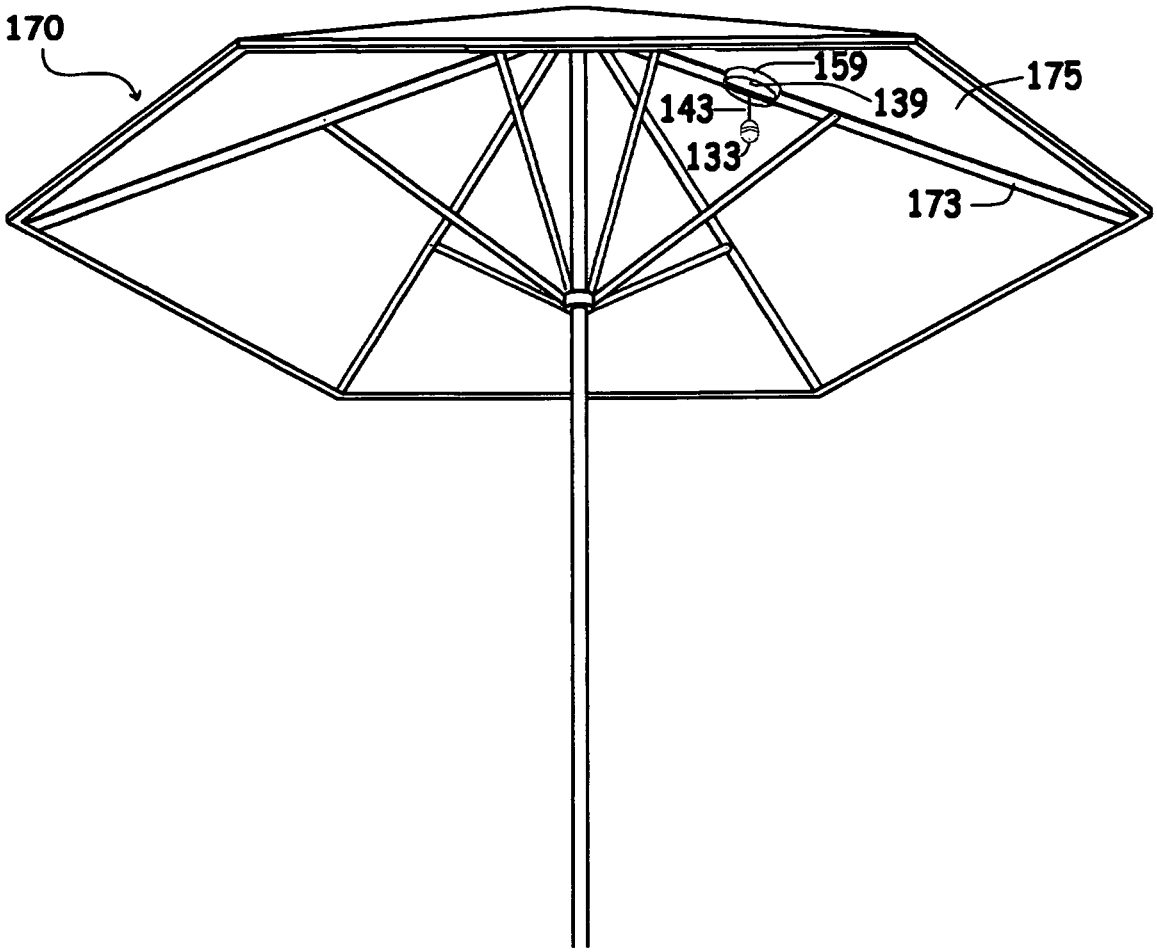
Figure 14:
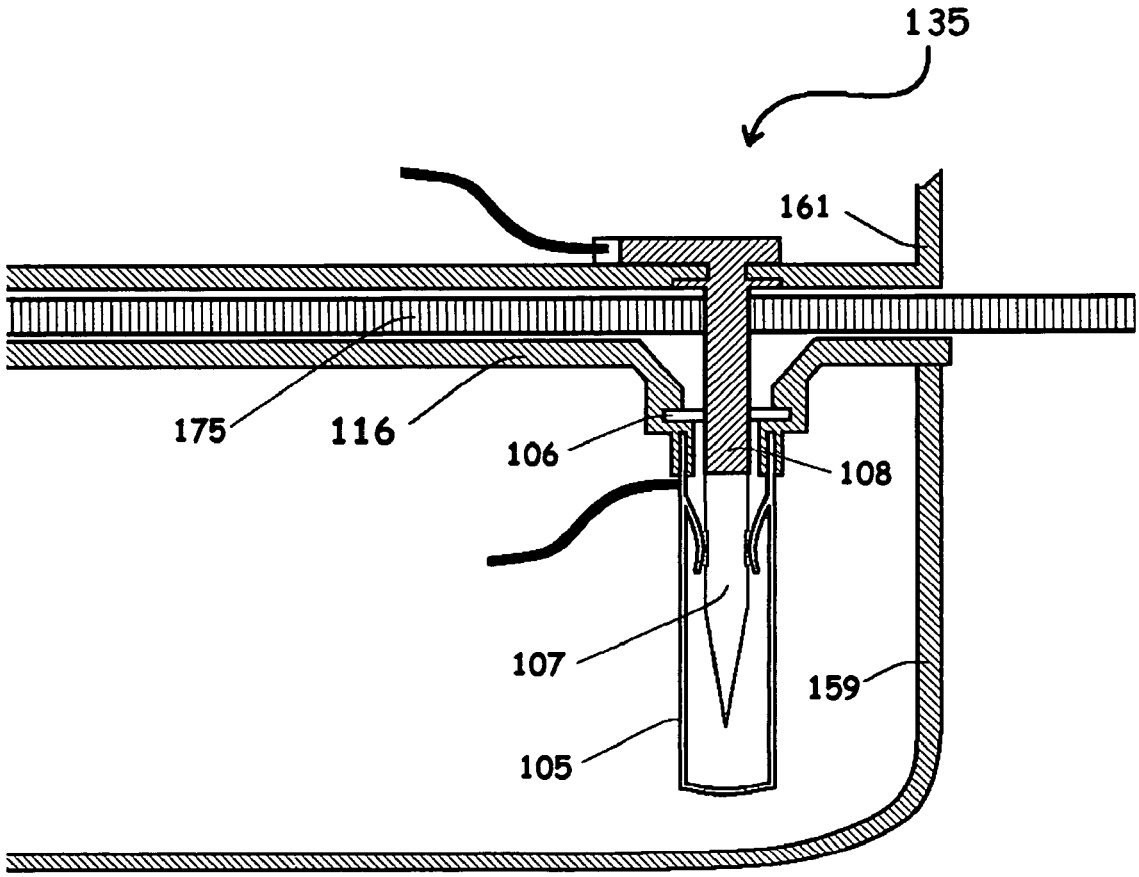
Figure 15:
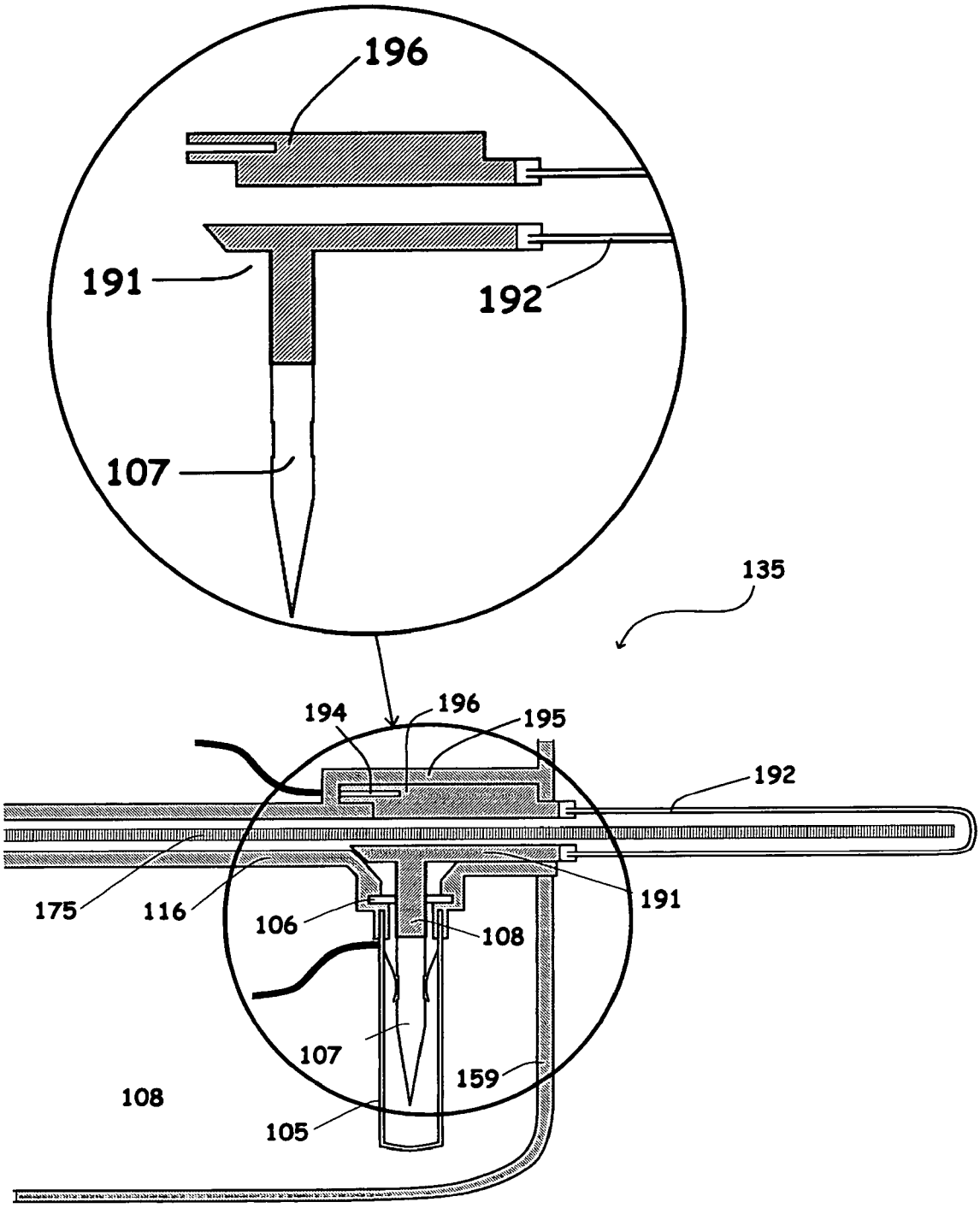
Figure 16:
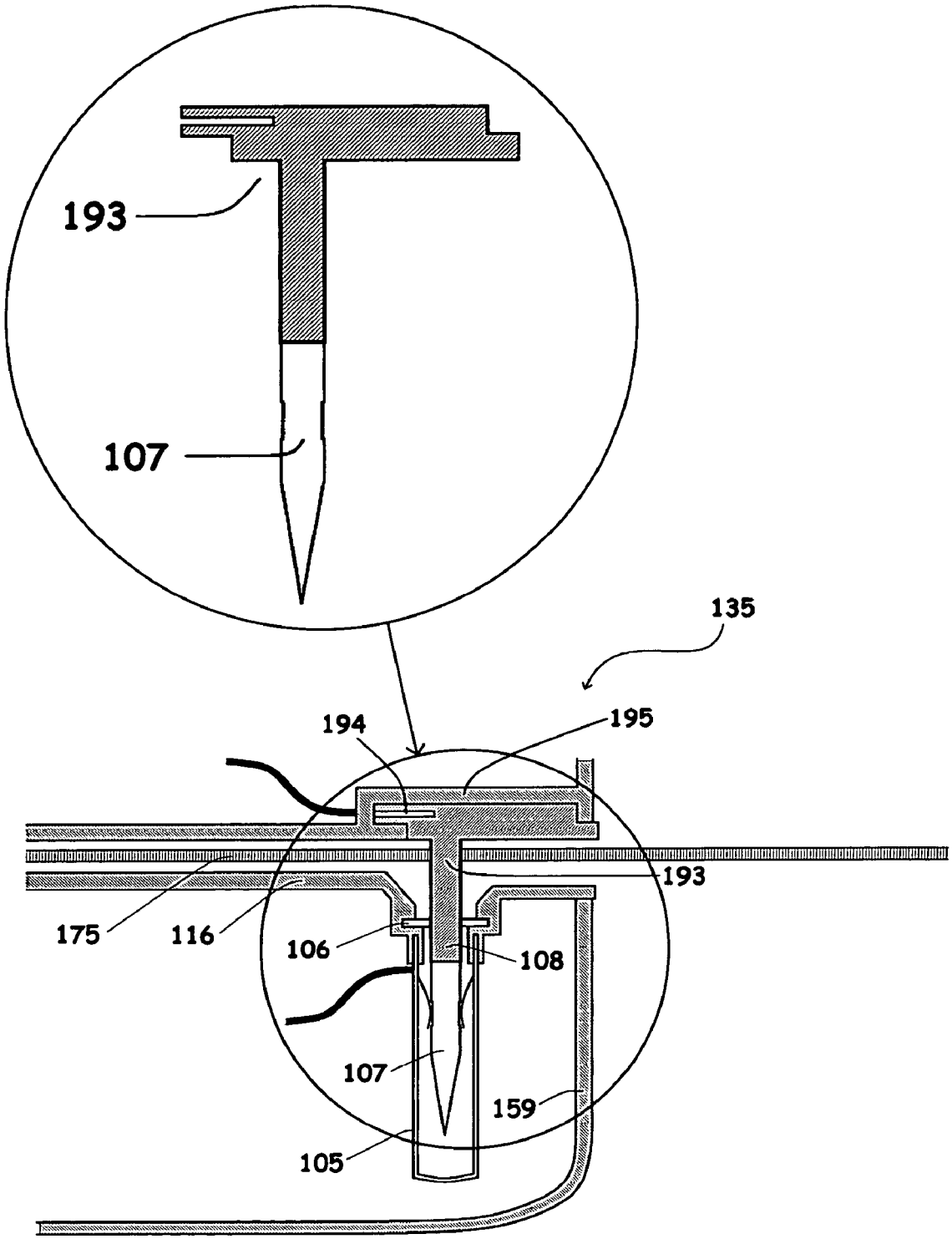

FIG. 7 is a lower oblique view of device 135 of FIG. 1, showing screws 181 and recessions 182 for screws 181;

FIG. 8 is a lower oblique view of embodiment 134 of the invention in which translucent lens 137 houses a plurality of LED bulbs 109, one or more of bulbs 109 being disposed on either side of the strut or framing member 175;

FIG. 9 shows lower housing portion 159 of device 134 of FIG. 8 installed over strut 173 of an umbrella, and beneath umbrella fabric 175;

FIG. 10 is a lower oblique view of embodiment 155 of the invention in which pins 107 are permanently attached to lower housing 159 and sockets 105 are attached to upper housing 161; FIG. 10 also shows spacers 160 used for adapting groove 176 to fit over narrow framing members or umbrella struts 173;

FIG. 11 is a diagram of circuit 201, one of many possible electrical circuits suitable for operatively connecting the various components of the invention;

FIG. 12 is a side view of the device of FIG. 1, and depicting lower housing 159 positioned over strut 173 of umbrella 170, and upper housing 161 positioned over umbrella fabric 175;

FIG. 13 is a lower oblique view of garden umbrella 170 supporting the device of FIG. 1;

FIG. 14 is a detailed cross-sectional cutaway view of key portions of the main upper and lower components of device 135 as shown in FIG. 1, wherein one means and method for operatively connecting the two main components across the fabric membrane of umbrella 175 employs one or a plurality of pins 107 and corresponding sockets 105;

FIG. 15 is a similar detailed view to that of FIG. 14, but shows also replaceable pin 107 as well as socket assembly 105 in which cable 192 is disposed around umbrella fabric 175 in order to connect the upper and lower housings of a device according to the invention in embodiments when piercing the fabric with pins is not desired;

FIG. 16 is a similar detailed view to that of FIG. 15, but shows an alternate replaceable pin 107 and socket 105 assembly to thus allow pins 107 to pierce fabric 175.

Figure 17:
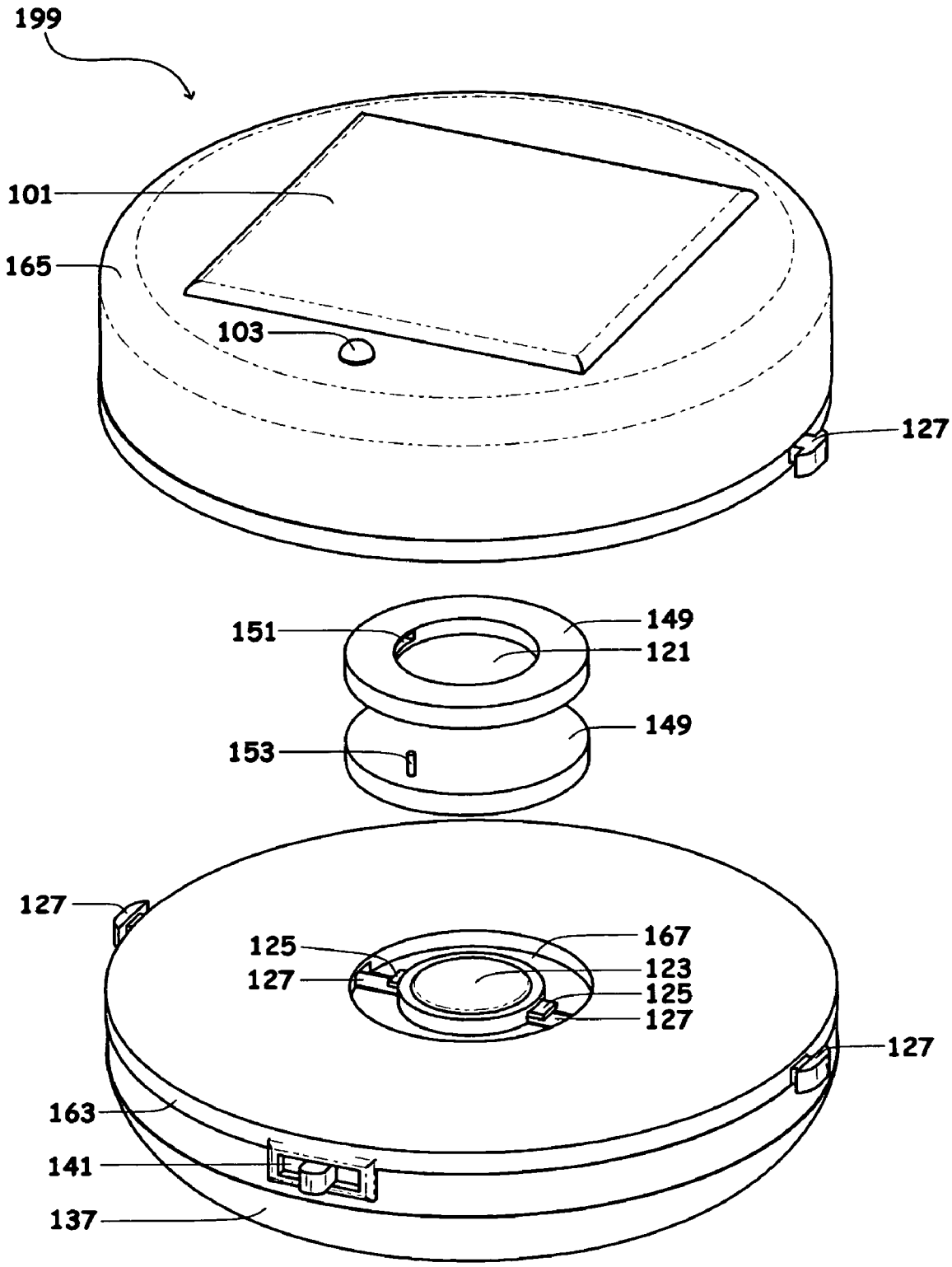
Figure 18:
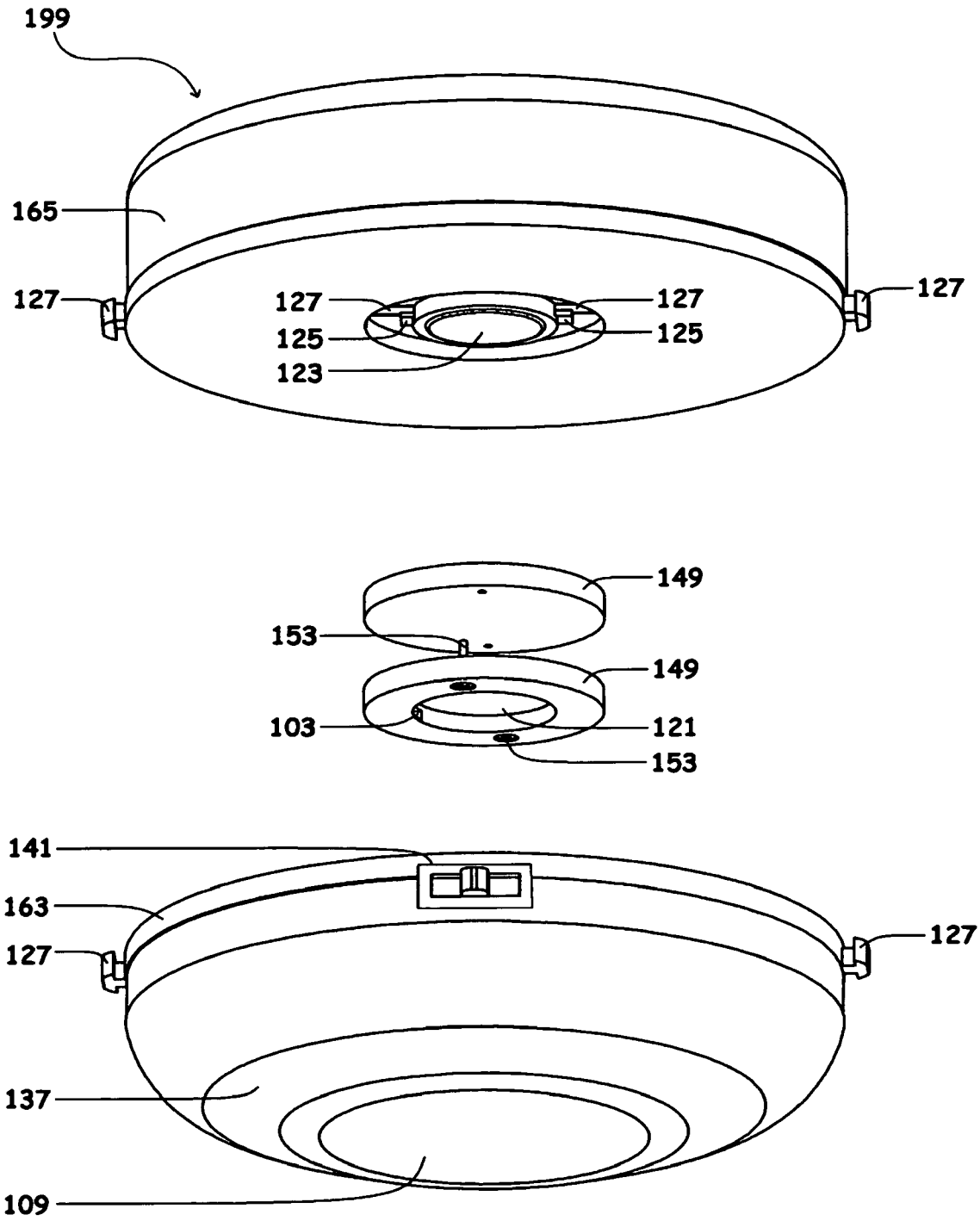
Figure 19:
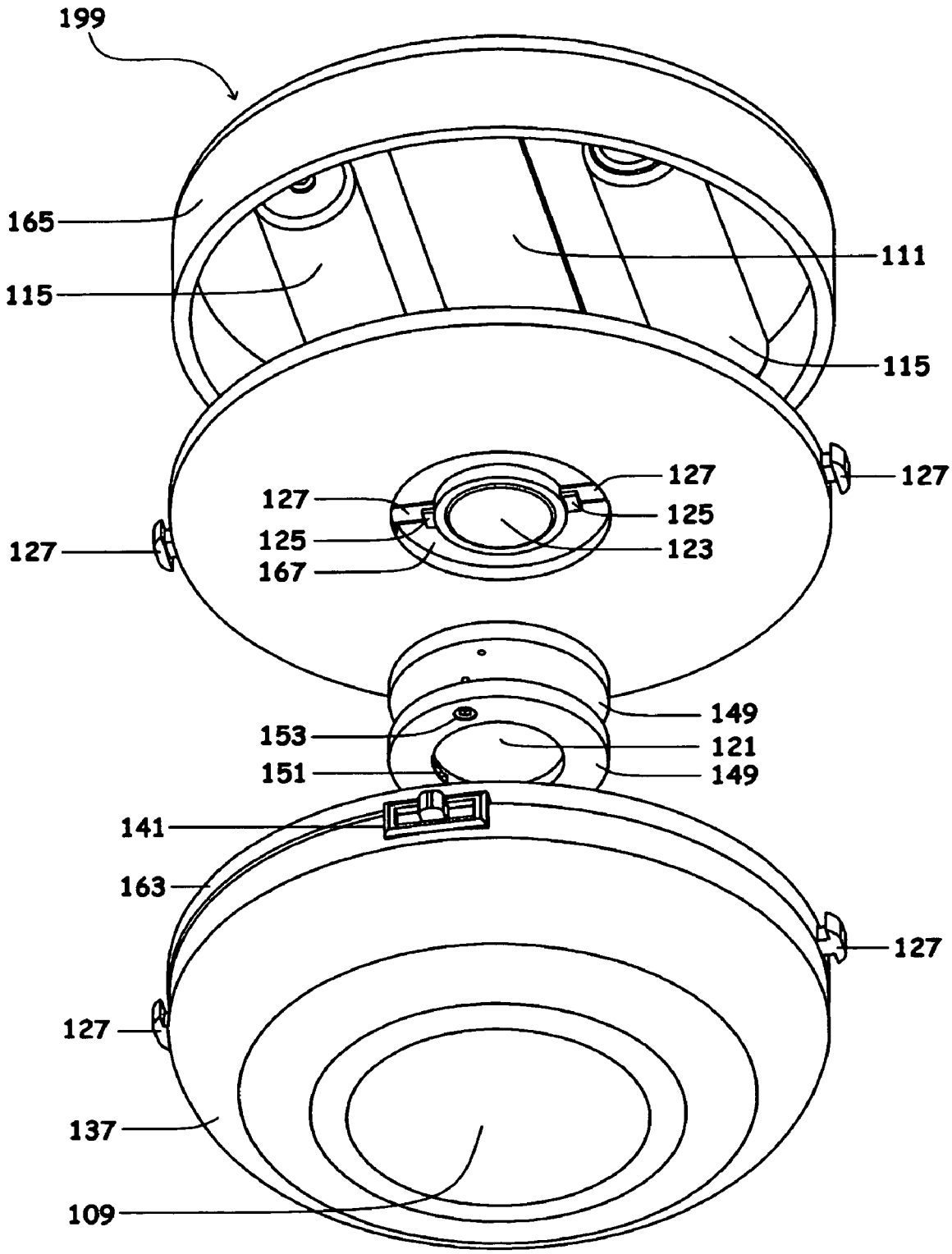
Figure 20:
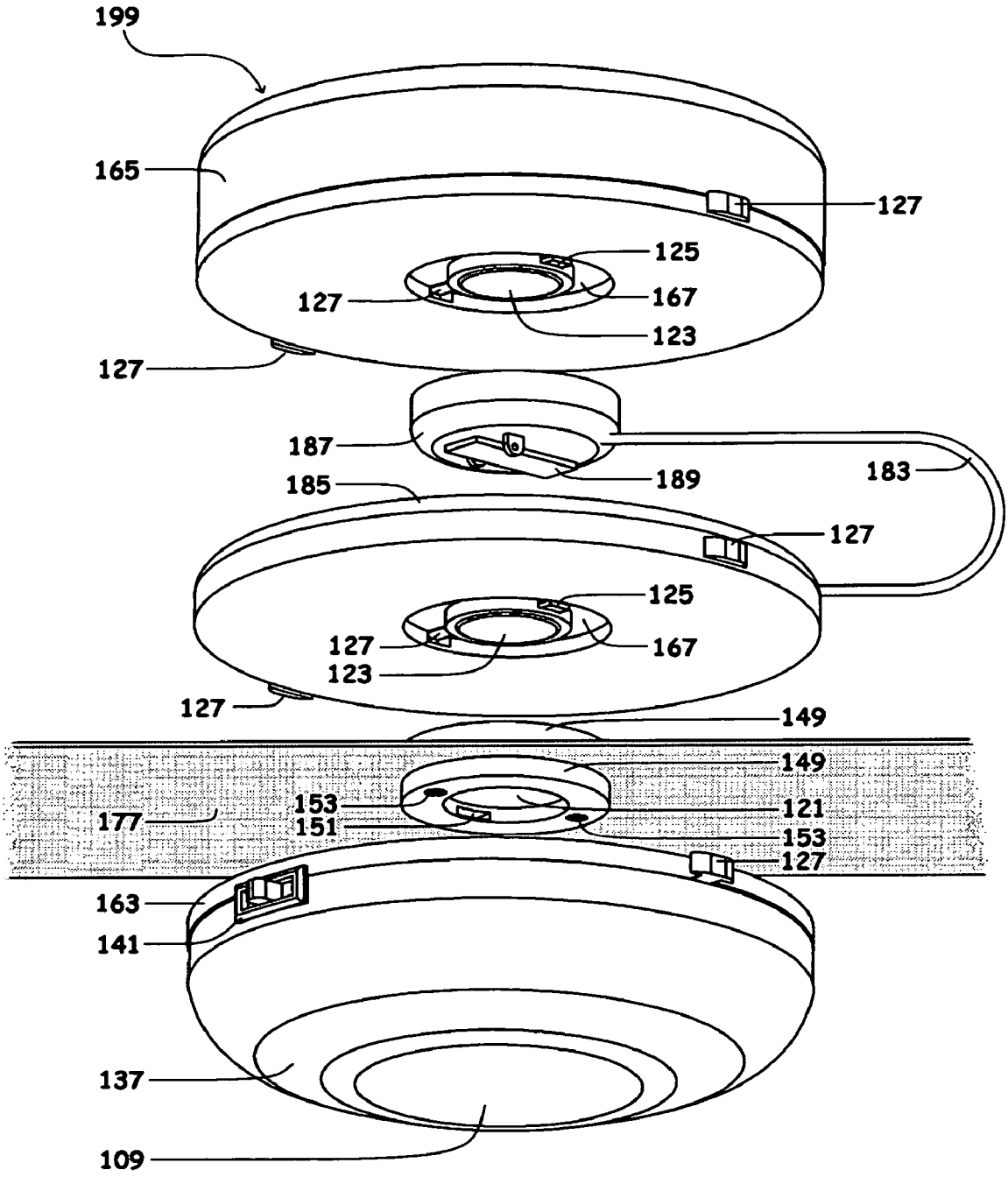
Figure 21:
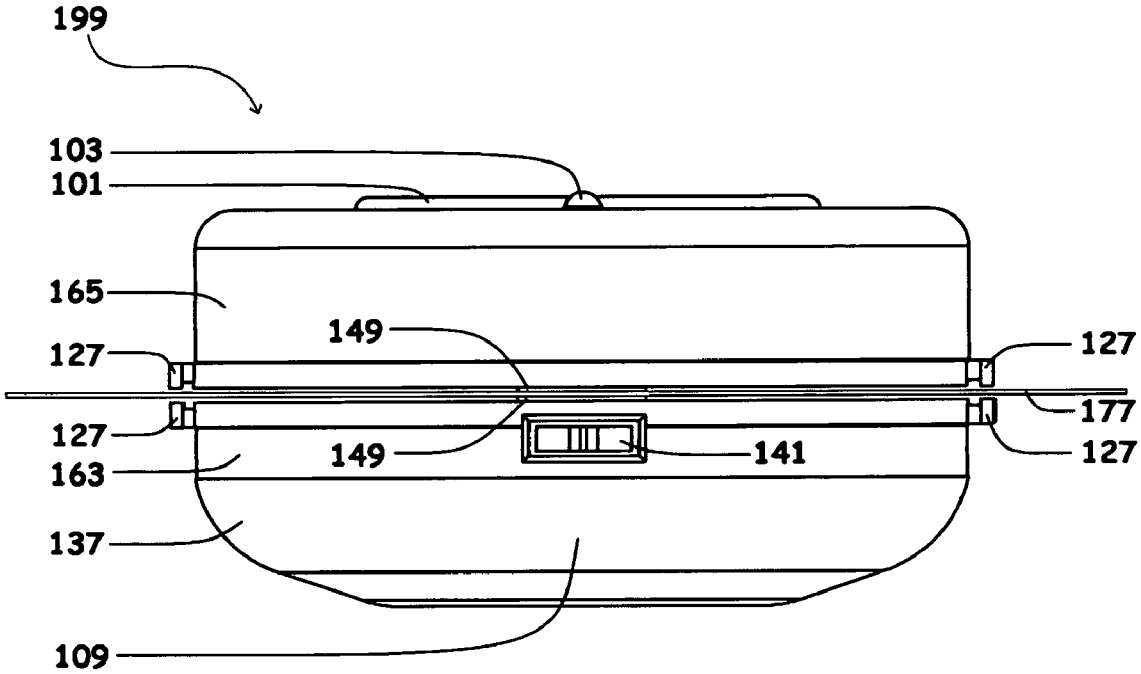
Figure 22:
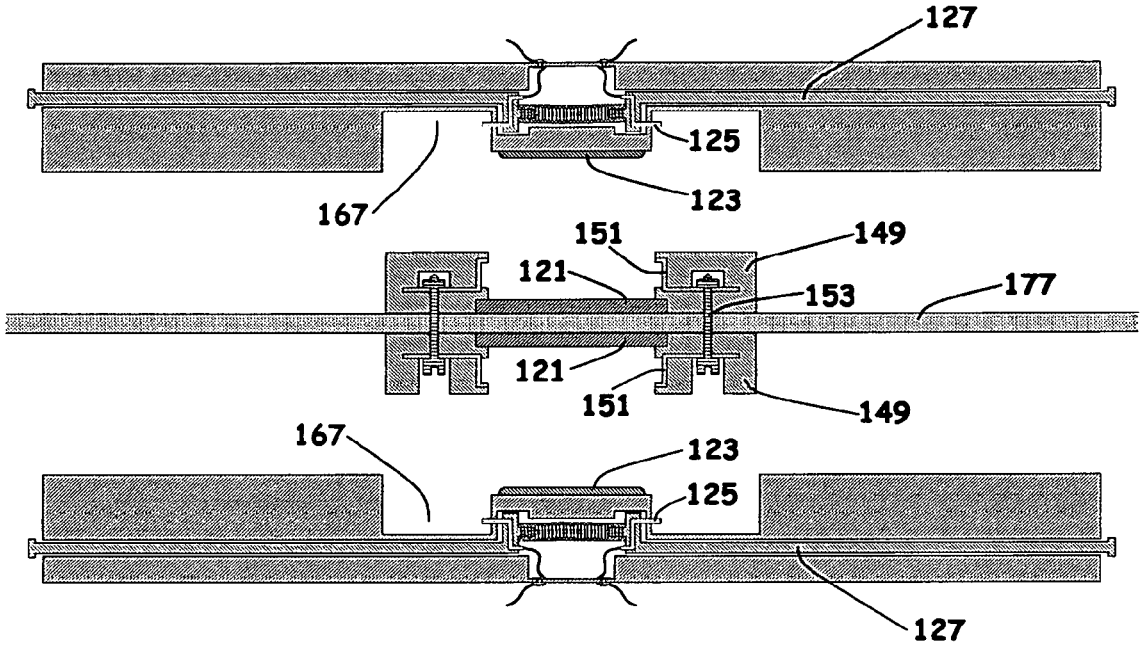
Figure 23:
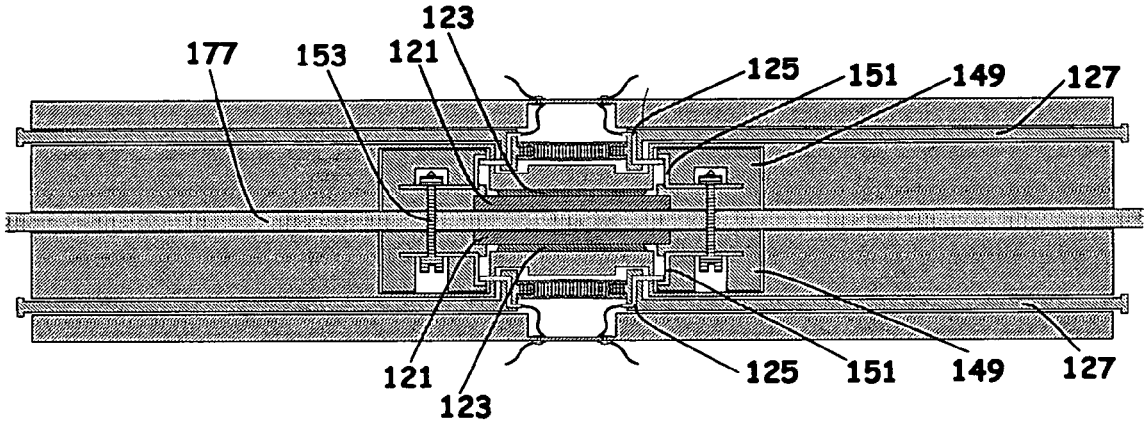
Figure 24:
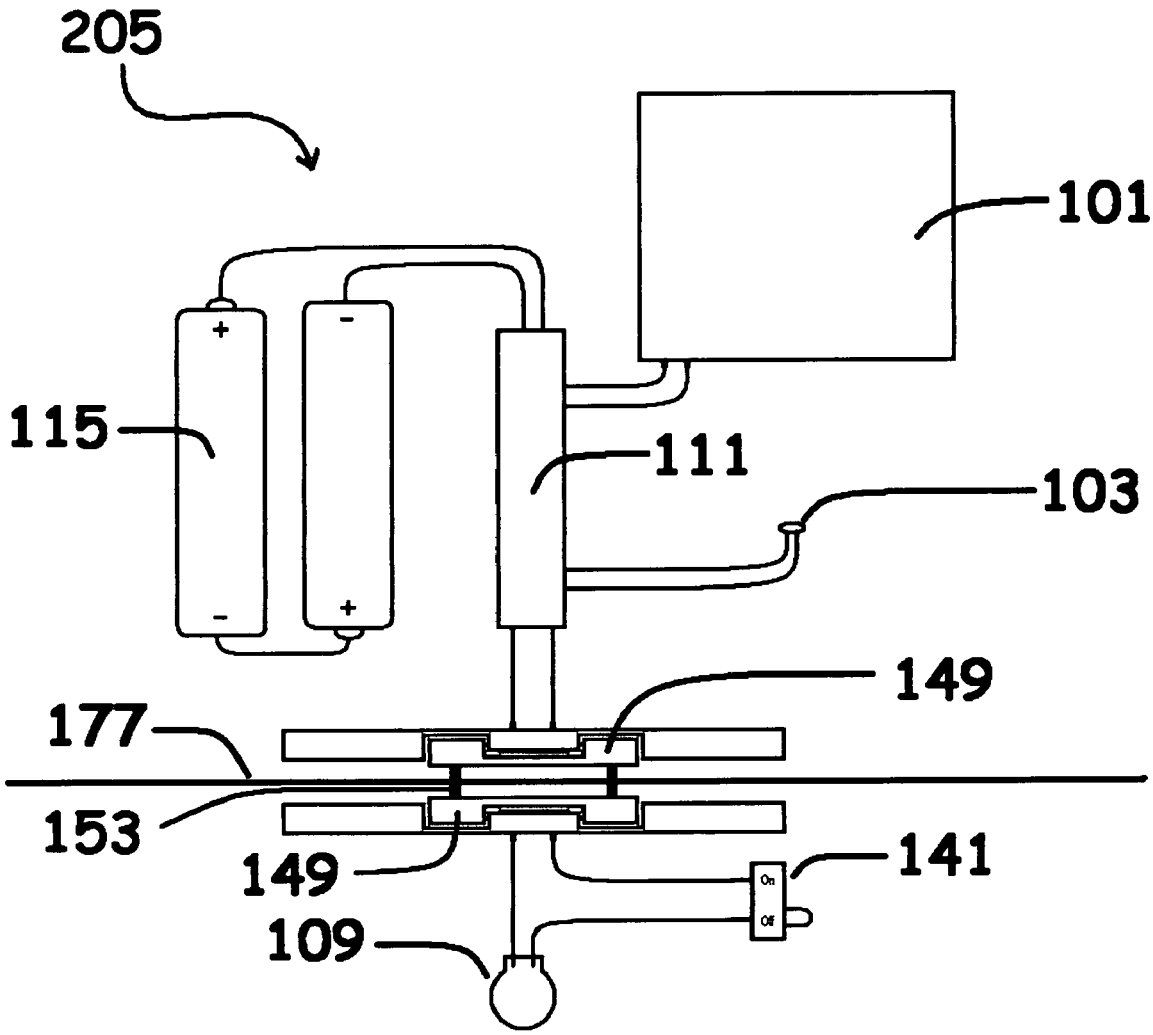
Figure 25:
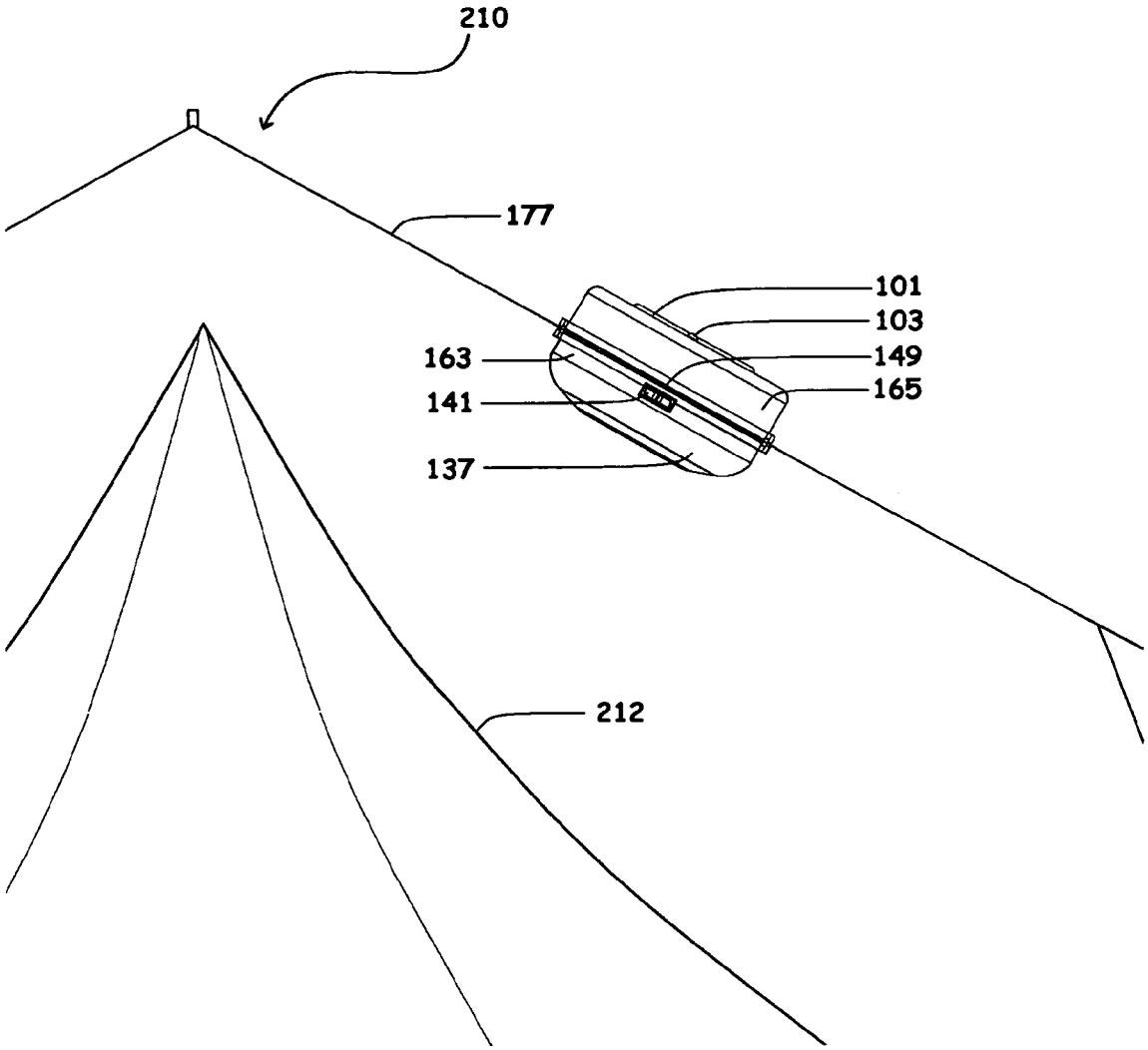
Figure 26:
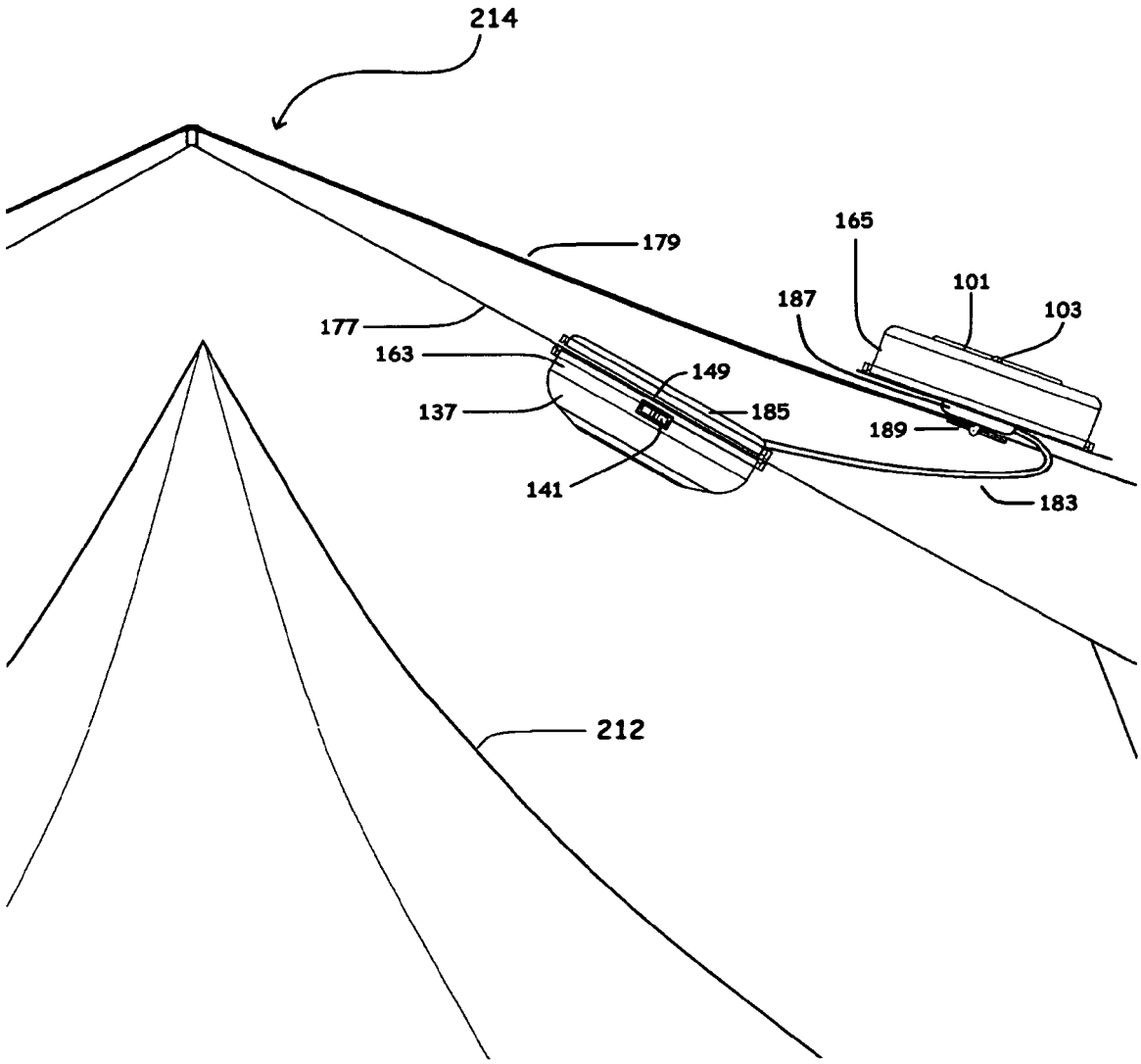
Figure 27:
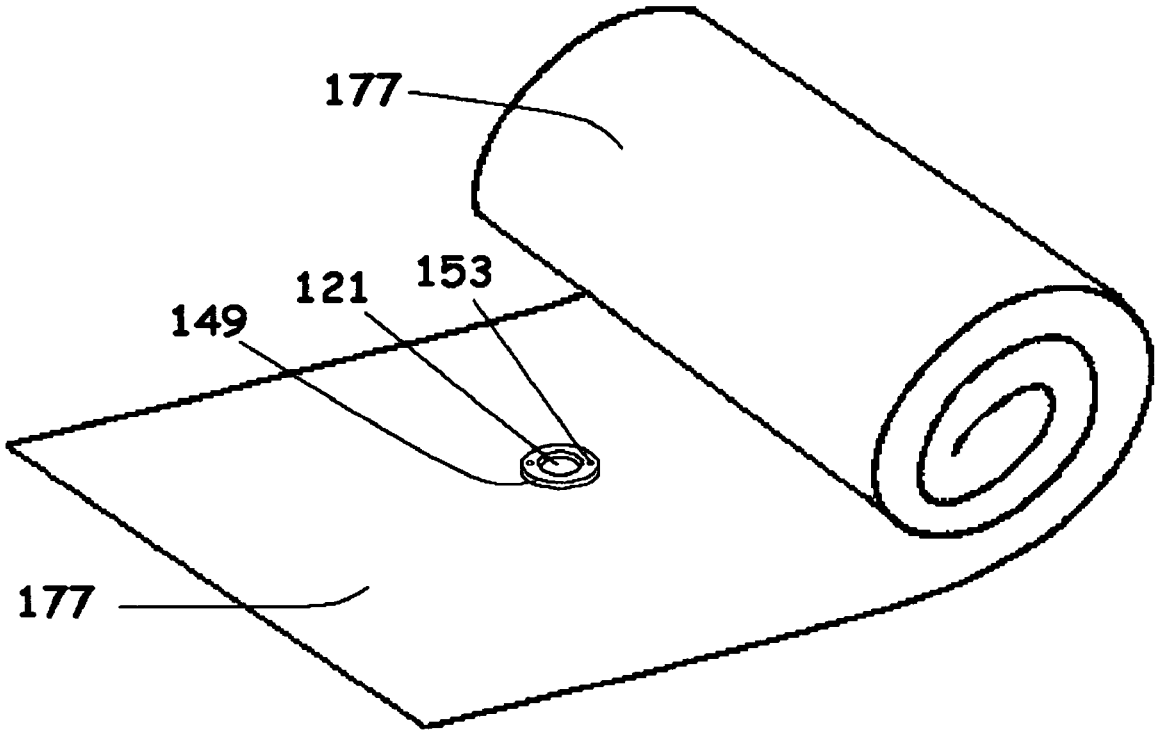

FIG. 17 is a side upper oblique view of alternate embodiment 199 of the invention suitable for disposition across a membrane such, as that found in an awning, umbrella, tent fly, tent layer, temporary shelter, or vehicle roof, wherein plastic discs are provided with embedded receptacles and adapted and arranged such that a fluid-resistant and operative connection can be established across the membrane;

FIG. 18 is a side lower oblique view of device 199 of FIG. 17;

FIG. 19 is a lower oblique exploded view of device 199 shown also in FIG. 17 and shows one possible arrangement for the circuit board, or circuitry, and batteries or other storage means;

FIG. 20 is a lower oblique view of device 199 of FIG. 17 showing one possible placement of tent fly cable 183;

FIG. 21 is a side view of embodiment 199 shown in FIG. 17 showing the placement of the components on both sides of fabric 177;

FIG. 22 shows a cross section through the center of typical upper and lower housings of typical embodiments of the invention, and depicts some salient elements of exemplary embodiments of the invention used to connect the main upper and lower components to disc receptacle 151 and disc 149 disposed across membrane 177. The elements are shown detached from one another with both inner and outer components separated from disc receptacles 149;

FIG. 23 shows the same elements depicted in FIG. 22, but wherein the upper and lower housings are shown operatively attached to one another by means of disc receptacles 149 positioned to hold the components together through fabric membrane 177;

FIG. 24 shows typical circuitry 205 suitable for operatively connecting embodiments of a device of the invention such as those shown in FIG. 17;

FIG. 25 depicts a side cross-sectional view of a portion of tent 210 wherein a device such as that of FIG. 17 is shown operatively installed across the exterior membrane of a multi-layered tent, or other fabric-based shelter, and disposed outside of inner layer 212 of tent 210;

FIG. 26 is a side cross-sectional view of a portion of multi-layered tent 214 wherein a device similar to that of FIG. 17, but provided with electrical cable 183 as depicted in FIG. 20, is depicted operatively installed with the main outer housing component 165 disposed on the outside of exterior fly 165 of multi-layered tent 214, or other fabric shelter, and having the inner main (lower lighting) component disposed at a distance from fly 165, and on the inside of inner layer 206 of tent 214;

FIG. 27 is a top oblique view of plastic discs 149 installed across the fabric of a tent 177 using machine screws 153 both as electrical conduits and as means of holding discs 149 and metal plates 121 in place across the fabric of tent 177 such that tent 177 can be rolled up or folded without difficulty.

Figure 28:
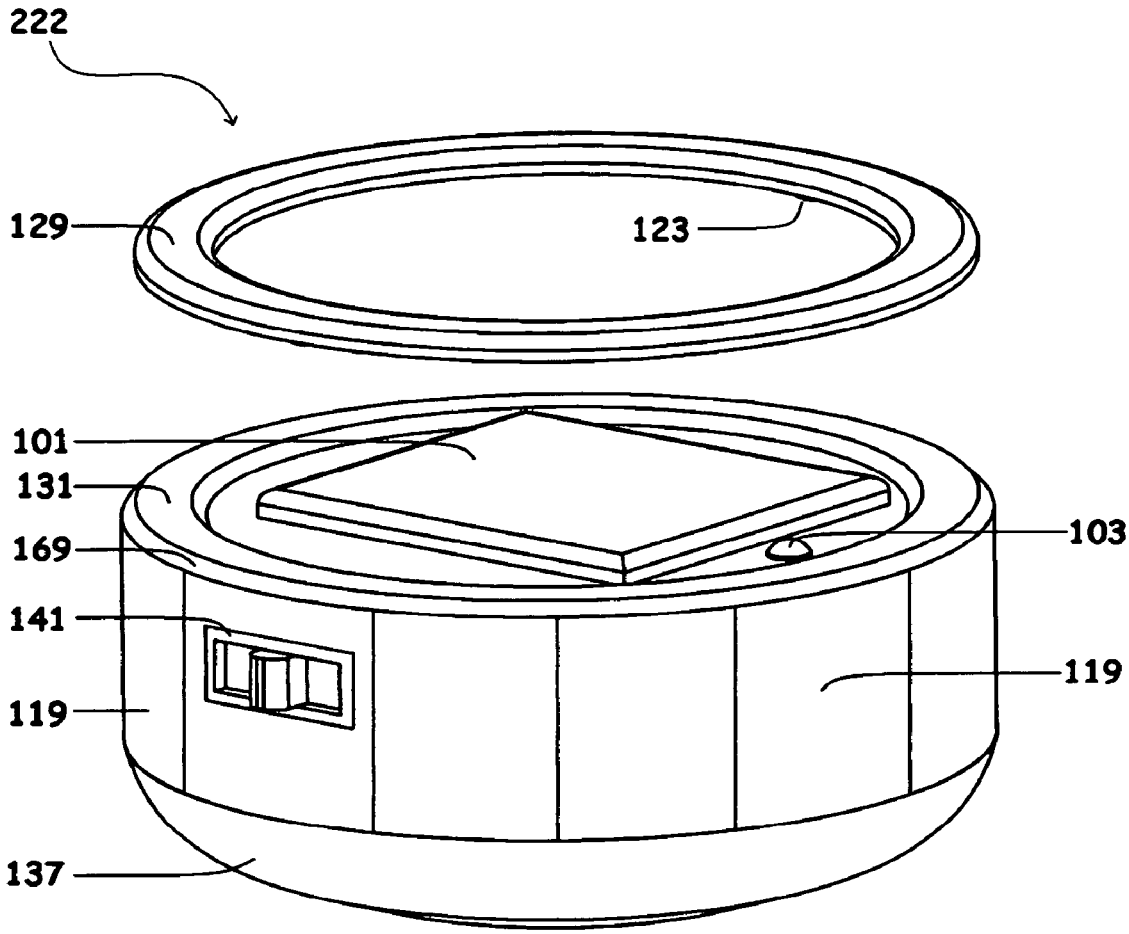
Figure 29:
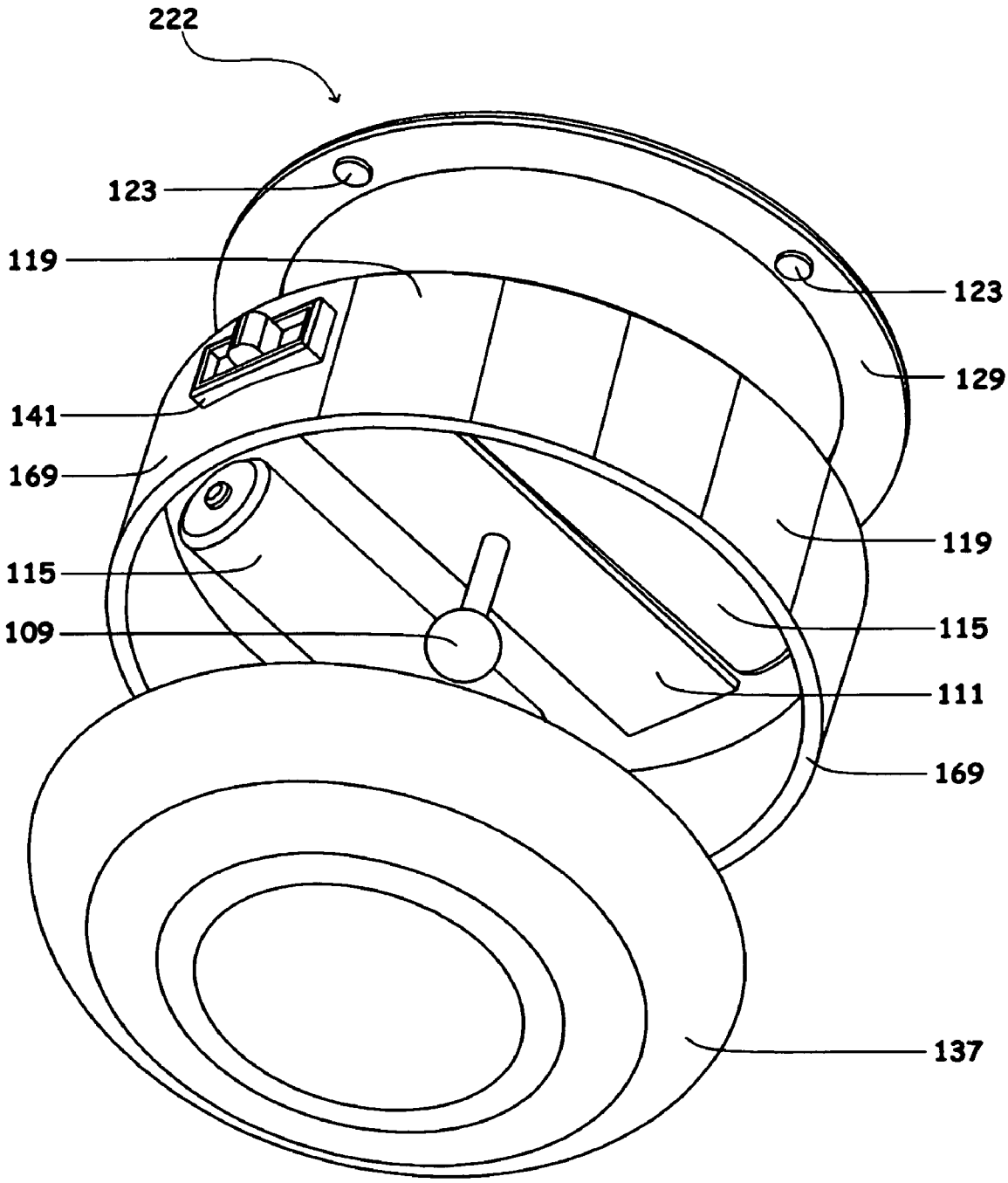

FIG. 28 is a top oblique view of embodiment 222 according to the invention adapted for use with a fabric structure comprising a transparent or semi-transparent section of membrane such as a glass or metallic sunroof in a tent or vehicle;

FIG. 29 is a lower oblique exploded view of embodiment 222 shown in FIG. 28.

Figure 30:
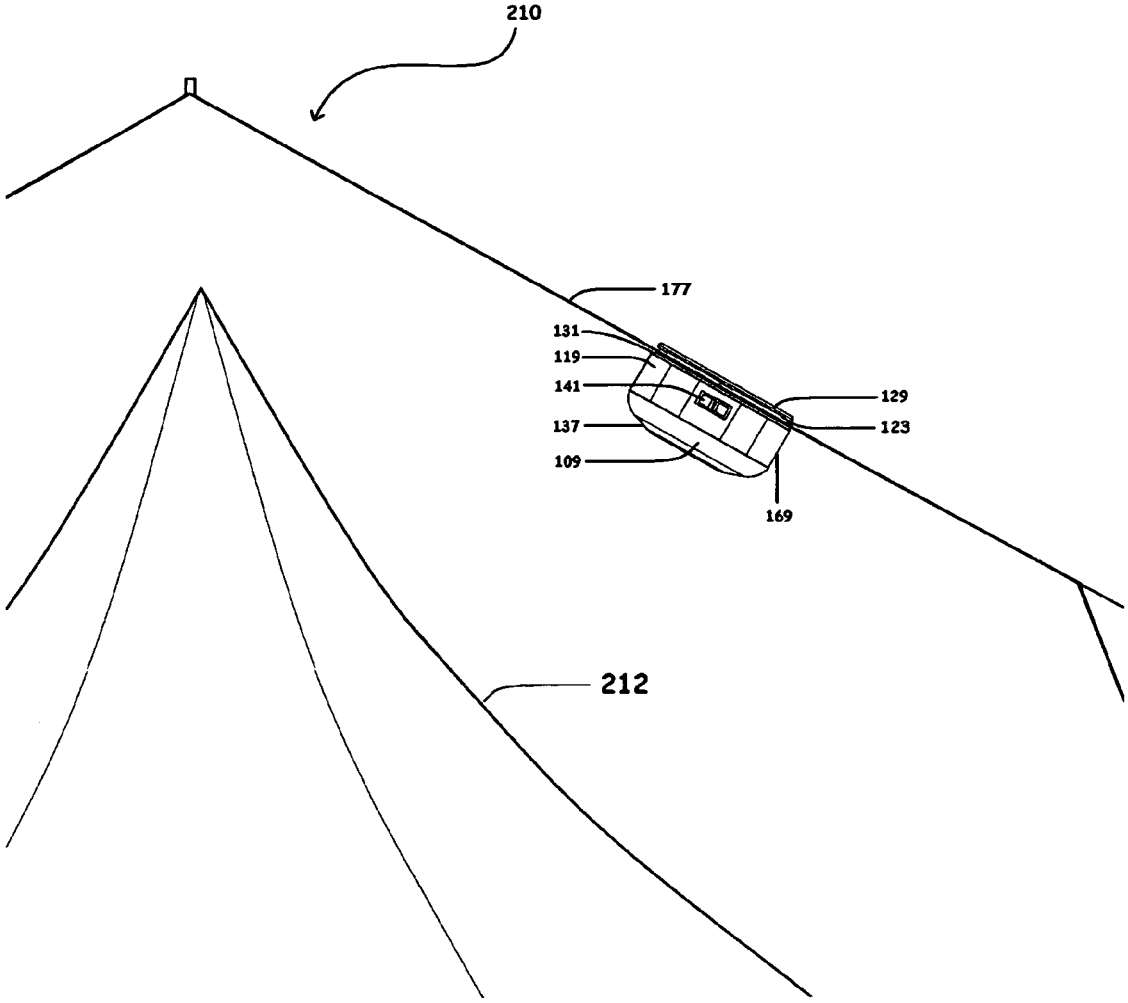
Figure 31:
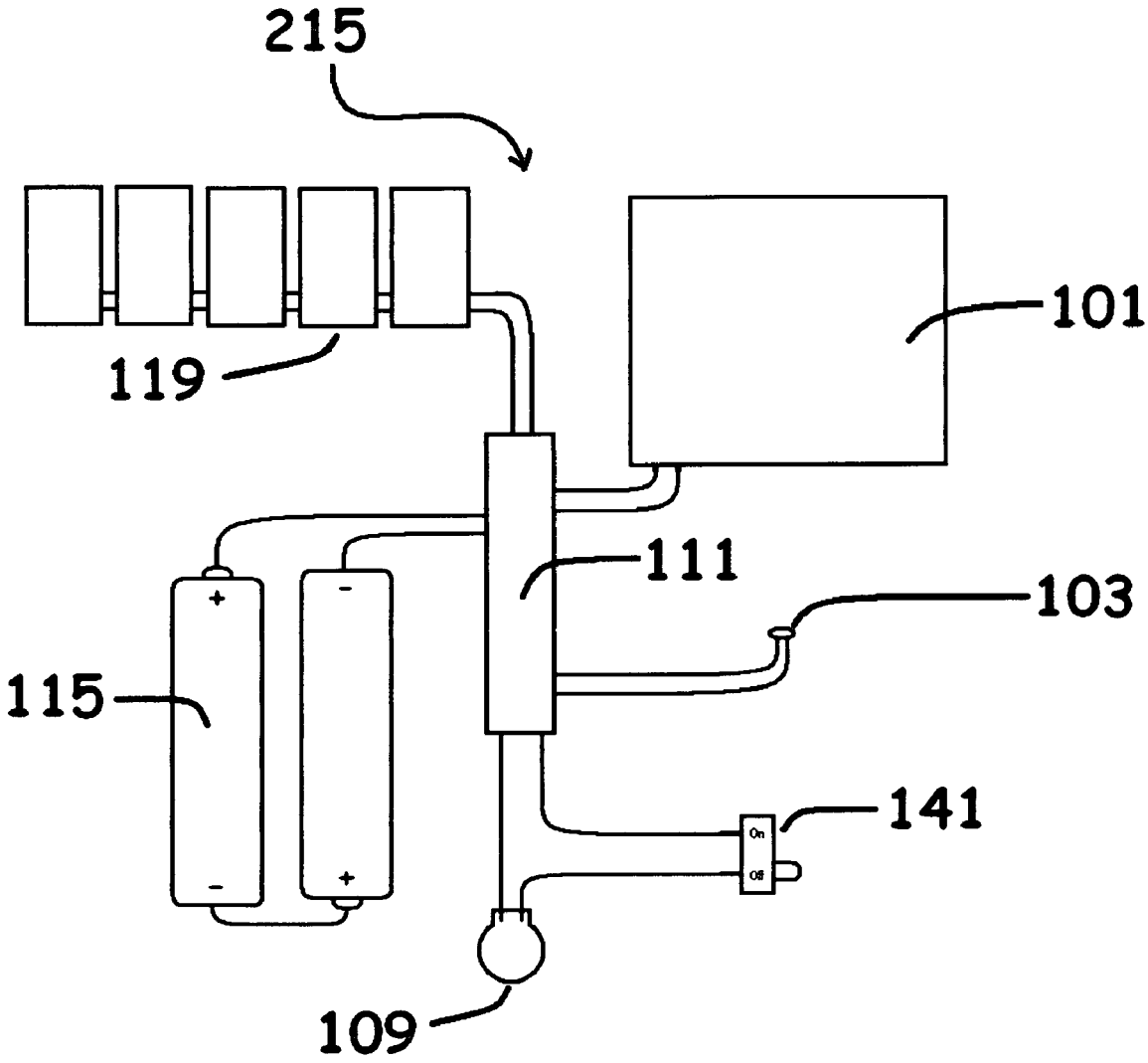

FIG. 30 shows a device of the invention, such as that shown in FIGS. 28 and 29, disposed across the exterior of tent 210, wherein the tent is provided with a transparent or semi-transparent section such as a plastic or fabric sunroof;

FIG. 31 is a diagram of circuit 215, one of many possible electrical circuits useful for operatively connecting the various components of the invention.

DESCRIPTION OF EXEMPLARY PREFERRED EMBODIMENTS

The present invention can also be understood with respect to the attached Figures where like numbers designate like features on the various Figures.

Figure 2:
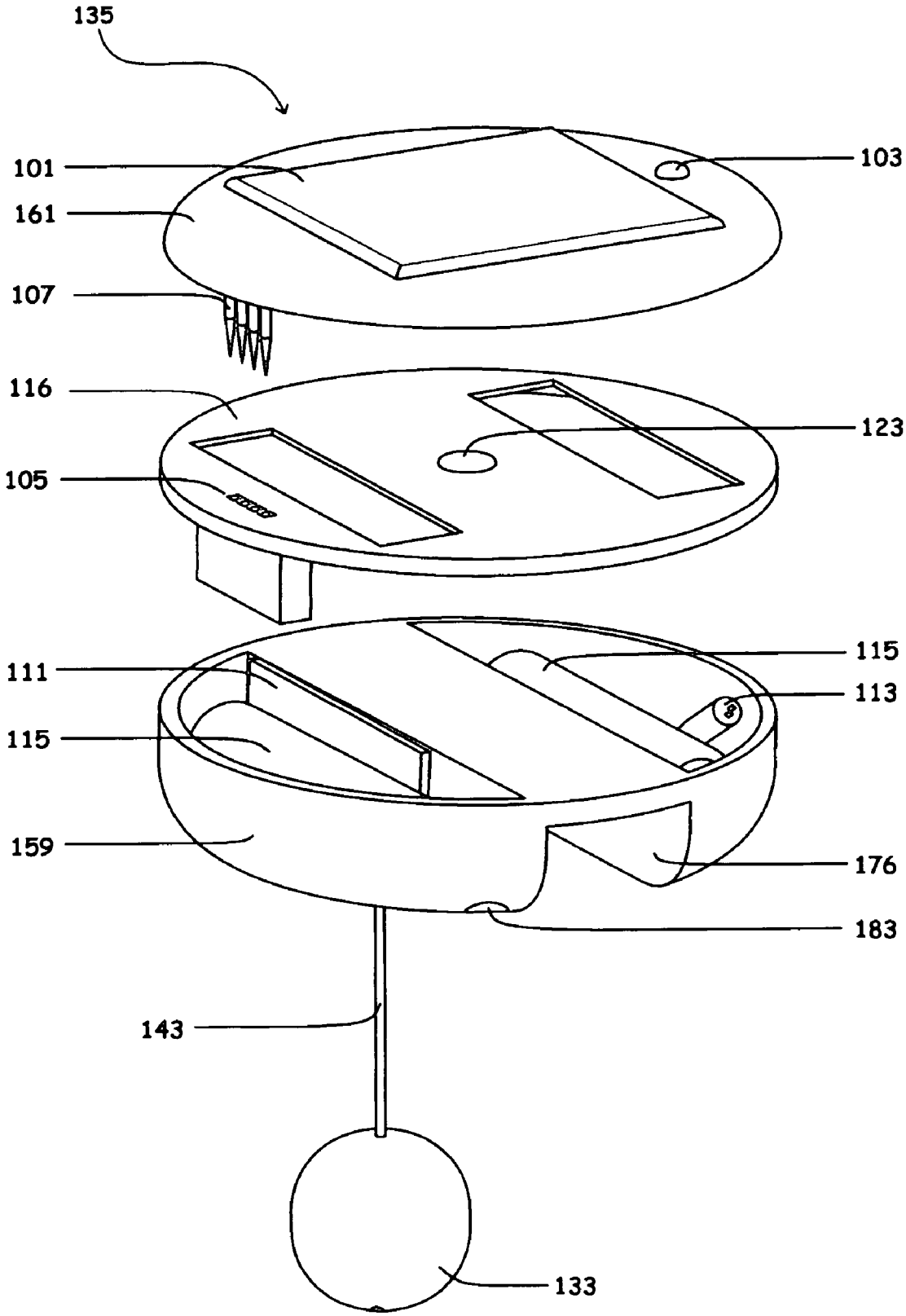

FIG. 1 is an upper oblique view of an embodiment of the invention adapted for use with a framed membrane or fabric structure, such as an umbrella, with the upper and lower housing separated and depicting radiant-energy gathering and illumination fixture 135 according to the invention. FIG. 2 is an upper oblique exploded view of the device of FIG. 1 depicting some key contents of lower housing 159, including rechargeable batteries 115, circuit board 111 and tilt switch 113;

With respect to FIGS. 1 and 2, solar panel 101 is disposed on outer plastic housing 161 near light sensor 103. Light sensor 103 is adapted for sensing radiant energy of a desired frequency band, for example, the visible light band or the solar radiation frequency band. Elements 101, 103 and 161 comprise the upper main component which, in use, is preferably disposed to face a source of radiant energy, such as the sun. Inner component plastic housing 159 is adapted and arranged for housing, among other things, rechargeable batteries 115, circuit board 111 and tilt switch 113. Inner component upper plate 116 is appropriately shaped to reversibly attach to housing 159 such that the inner components can be accessed when needed and batteries 115 can be changed when needed or desired. Upper plate 116 is provided with conductive sockets 105 which are adapted and arranged to operatively engage conductive pins 107 which are disposed within upper housing 161 to penetrate through, such as by piercing, a membrane across which the device is attached, such as a portion of a patio umbrella. Thus, radiant energy impinging upon solar cell 101 is converted therein to electricity, and the electricity is conducted via pins 107 to batteries 115 where it is stored as chemo-electric energy for use later by, for example, LED bulb 109. Circuit board 111 is operatively connected to the various electrical components of the device in such a manner that it coordinates the various electrical operations such as switching, routing of electrical power, and sensing.

In the embodiment shown, LED bulb 109 is disposed within translucent fixture 135 and is suspended by flexible fixture cable 143 from housing 159. Fixture cable 143 contains conductive wiring (not shown) which operatively connects LED bulb 109 to circuit board 111, batteries 115, tilt switch 113 and switch 139.

Figure 3:
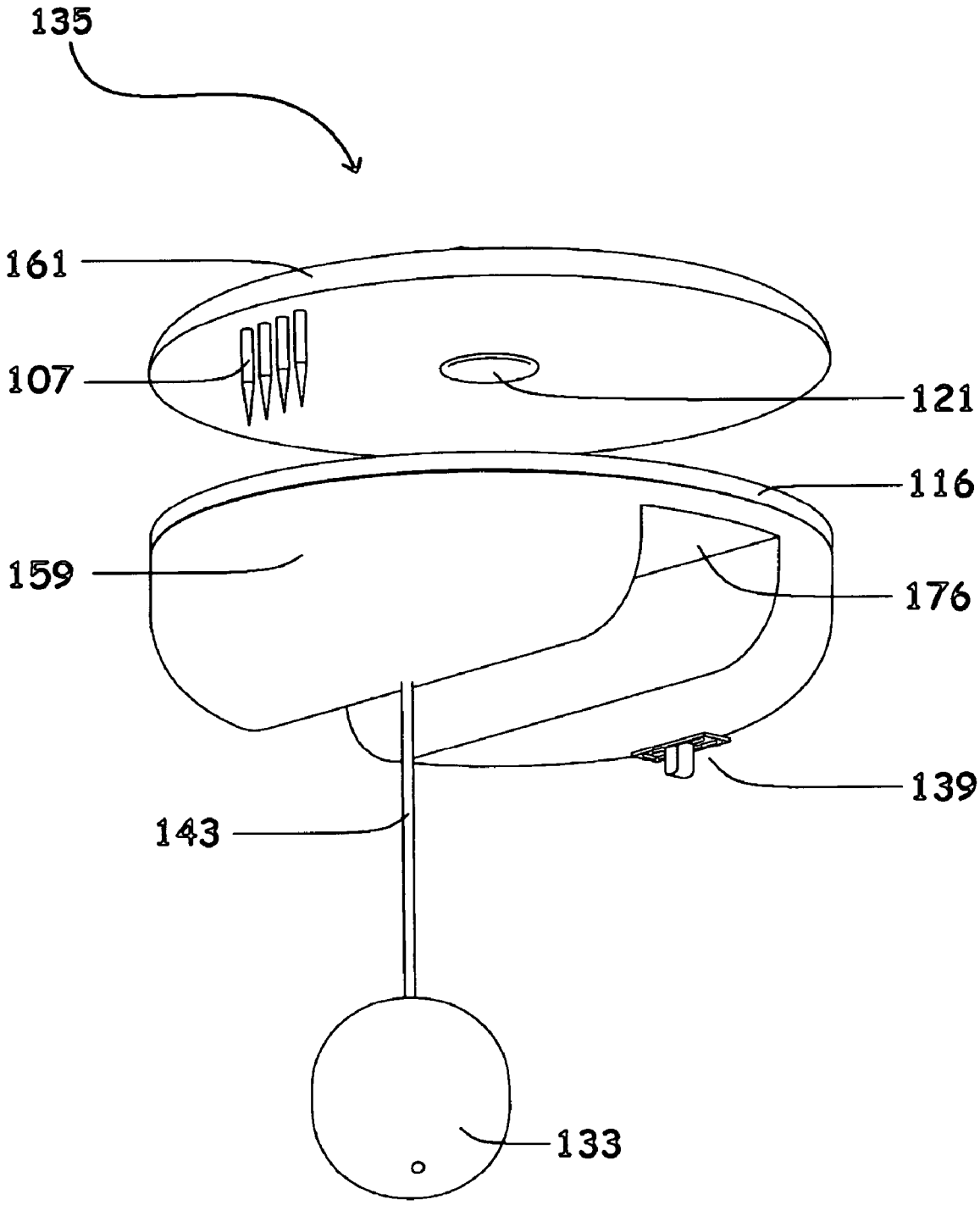
Figure 4:
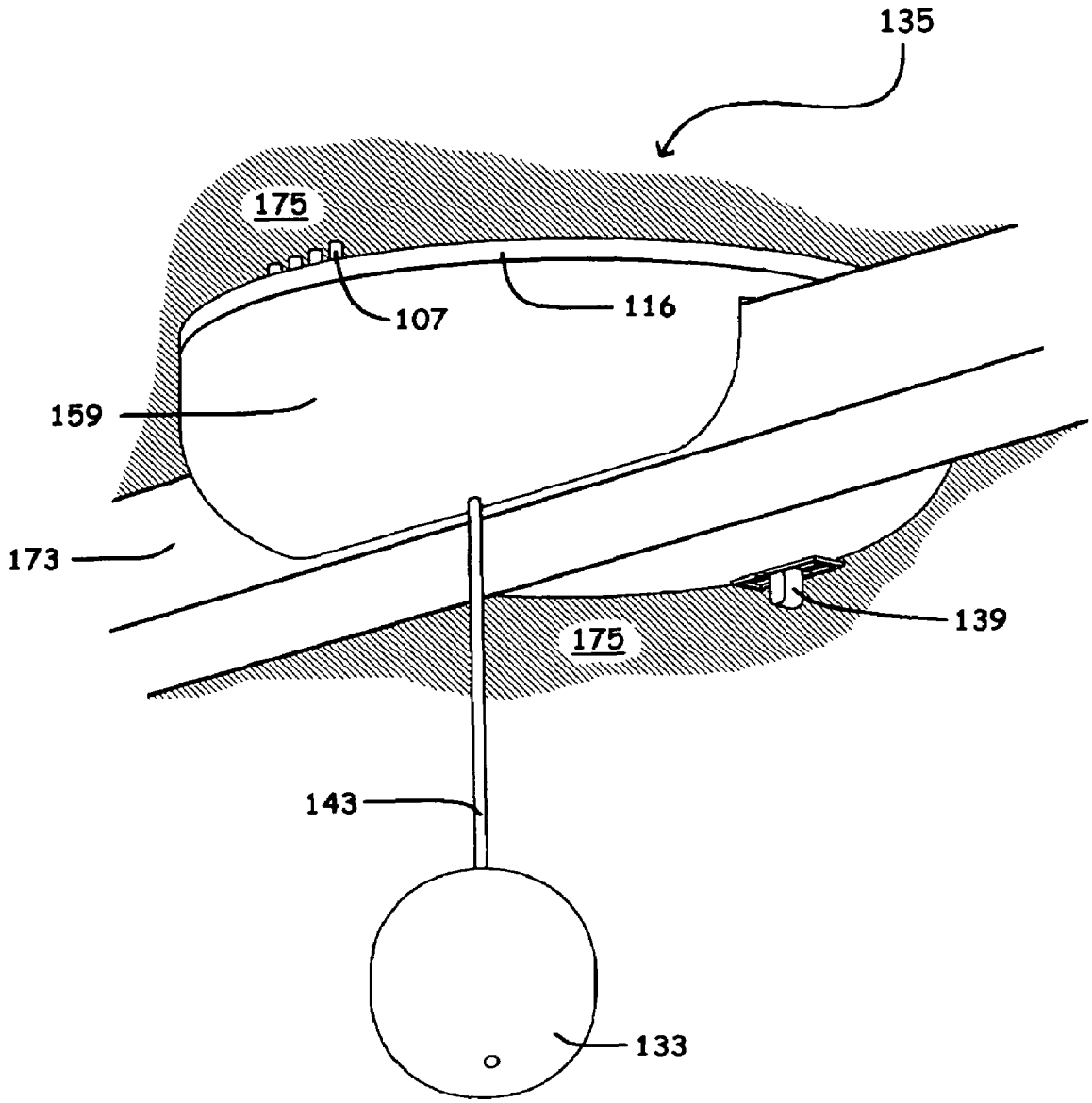
Figure 5:
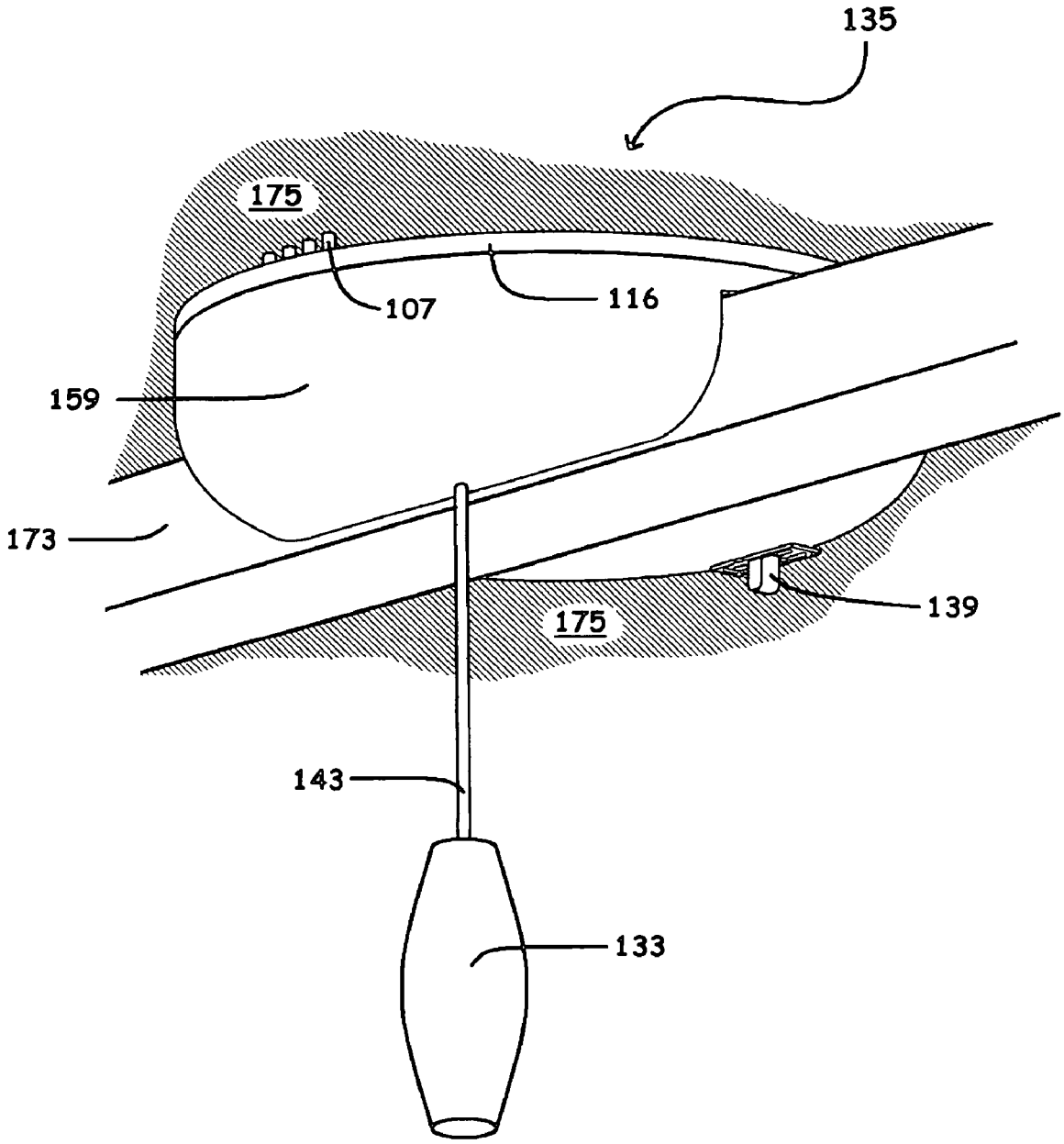
FIG. 5 shows device 135 of FIG. 1 supporting an alternate preferred embodiment of translucent illumination element 133.
Figure 6:
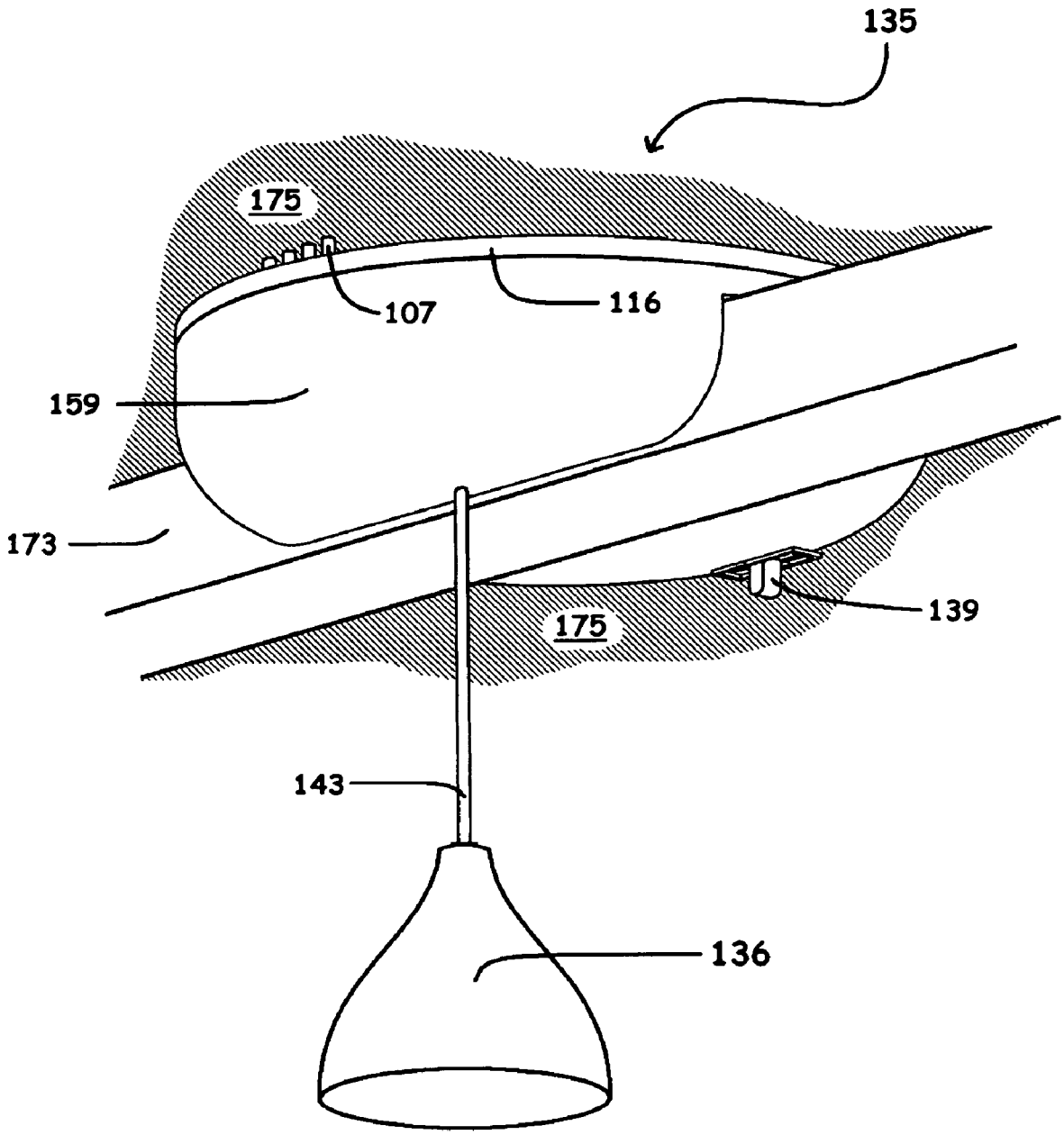
FIG. 6 shows device 135 of FIG. 1 supporting reflective fixture 136.

FIG. 3 is a lower oblique view of the embodiment of FIG. 1 showing metal plate 121 and three-position switch 139. FIG. 4 shows lower housing 159 of device 135 of FIG. 1, installed over a strut of an umbrella, beneath umbrella fabric 175, and supporting translucent illumination element 133. FIG. 5 shows device 135 of FIG. 1 supporting an alternate preferred embodiment of translucent illumination element 133. FIG. 6 shows device 135 of FIG. 1 supporting reflective fixture 136.

In some preferred embodiments, lower housing 159 is provided with a groove, such as groove 176 as shown in FIGS. 1, 2 and 3, for installing the device on the strut of an umbrella. With respect to FIGS. 3, 5 and 6, lower component housing 159 is shown disposed over strut 173 of umbrella U. Thus, a reflective or translucent fixture 133 or 135, and switch 139 are located on the lower, or inside, surface of membrane 175 of umbrella U. Pins 107 are shown disposed through umbrella membrane 175. Thus, light fixture 133 or 135 is disposed on the inside of umbrella U by means of cable 143. On the outer, or upper, surface of umbrella membrane 175, pins 107 are disposed within upper main housing component 161 and operatively engage corresponding sockets 105 which in turn are disposed within lower main housing component 159 which is demountably attached on the upper surface of membrane 175 such that it receives radiant energy (not shown).

FIG. 7 is a lower oblique view of device 135 of FIG. 1, showing screws 181 and recessions 182 for receiving screws 181. In the embodiment shown in FIG. 7, screws 181 are inserted through recessions 182 in the lower housing 159 and into the upper housing 161 as an optional means to more permanently secure the upper and lower housings together through the fabric membrane 175.

FIG. 11 shows a typical circuit connecting the electrical components of one preferable embodiment of the invention. As one of skill in the art will comprehend, many different schemes of component circuitry can be used with the many embodiments and remain within the scope and spirit of the invention. An alternate circuitry embodiment is shown in FIG. 24. Yet another circuitry embodiment is shown in FIG. 31 where housing 169 is shown provided with a bank of auxiliary solar panels 119.

FIG. 8 is a lower oblique view of embodiment 134 of the invention in which translucent lens 137 houses a plurality of LED bulbs 109, one or more of bulbs 109 being disposed on either side of the strut or framing member 175. FIG. 9 shows lower housing portion 159 of device 134 of FIG. 8 installed over strut 173 of an umbrella, and beneath umbrella fabric 175. FIG. 10 is a lower oblique view of embodiment 155 of the invention in which pins 107 are permanently attached to lower housing 159 and sockets 105 are attached to upper housing 161. FIG. 10 also shows spacers 160 used for adapting groove 176 to fit over narrow framing members or umbrella struts 173. FIG. 11 is a diagram of circuit 201, one of many possible electrical circuits suitable for operatively connecting the various components of the invention. FIG. 12 is a side view of the device of FIG. 1, and depicting lower housing 159 positioned over strut 173 of umbrella 170, and upper housing 161 positioned over umbrella fabric 175.

FIG. 13 is a lower oblique view of garden umbrella 170 supporting the device of FIG. 1. FIG. 14 is a detailed cross-sectional cutaway view of key portions of the main upper and lower components of device 135 as shown in FIG. 1, wherein one means and method for operatively connecting the two main components across the fabric membrane of umbrella 175 employs one or a plurality of pins 107 and corresponding sockets 105. FIG. 15 is a similar detailed view to that of FIG. 14, but shows also replaceable pin 107 as well as socket assembly 105 in which cable 192 is disposed around umbrella fabric 175 in order to connect the upper and lower housings of a device according to the invention in embodiments when piercing the fabric with pins is not desired. FIG. 16 is a similar detailed view to that of FIG. 15, but shows an alternate replaceable pin 107 and socket 105 assembly to thus allow pins 107 to pierce fabric 175.

FIGS. 14, 15 and 16 show typical cross-sectional details of some preferred embodiments of means according to the invention for connecting the main upper and lower components through a membrane, such as the fabric of an umbrella, awning, or temporary shelter. With respect to FIG. 14, pin 107 extends from plastic housing 161, through fabric membrane 175 of umbrella U and into corresponding socket 105 which is disposed within lower housing 159. Pin 107 is provided with non-conductive coating 108. Housing 159 is provided with rubber grommet 106 of a size and disposition to sealably engage pin 107 at a level about which anti-conductive coating 108 is disposed. Thus, main upper component housing 161 and main lower component housing 159 can be operatively connected through membrane 175 in a manner which sealably excludes moisture and dirt, while protecting the electrically conductive path between the two main components.

FIGS. 15 and 16 show other typical cross-sections of different preferred embodiments where alternate upper housing 195 and lower housing 159 are sealably disposed on opposite sides of tent membrane 175 by means of several different types of pin/conductor combinations. For example, wire 192, which operatively connects conductive pin assembly 191 to lower housing 159, is of an appropriate length that it can be threaded, for example, through an umbrella or tent vent hole. Alternate Upper Housing 195 is provided with plug 194 adapted for receiving socket 196 so that wire 192 can be detached and reattached to upper housing 195 after wire 192 is threaded through such a vent hole (not shown). Alternatively, indented receptacle 195 is adapted and arranged such that it can be used with pin 193 which is adapted for piercing through membrane 175.

FIG. 10 depicts yet another embodiment of a device according to the invention. With respect to FIG. 10, the trans-membrane lighting device is shown with an enlarged upper housing 161 having solar panel 101 and light sensor 103 thereon. Conductive sockets 105 are also disposed within upper housing 161. Lower housing 159 of device 10 is provided with pins 107 which are adapted for piercing or crossing a membrane, such as that of an umbrella, awning, gazebo, or temporary shelter. Lower housing 159 of device 8 is provided with groove 176 which is constructed and arranged to receive a component of a structure with which the device is to be used such as an umbrella strut, tent pole or convertible vehicle roof support bar.

Devices according to the invention can further be understood with respect to the following continued description, and with respect to all of the Figures, and particularly with respect to FIGS. 17, 18, 19, 20, 21, 25 and 26 in which like numbers identify like elements.

FIG. 17 is a side upper oblique view of alternate embodiment 199 of the invention suitable for disposition across a membrane such, as that found in an awning, umbrella, tent fly, tent layer, temporary shelter, or vehicle roof, wherein plastic discs are provided with embedded receptacles and adapted and arranged such that a fluid-resistant and operative connection can be established across the membrane. FIG. 18 is a side lower oblique view of device 199 of FIG. 17. FIG. 19 is a lower oblique exploded view of device 199 shown also in FIG. 17 and shows one possible arrangement for the circuit board, or circuitry, and batteries or other storage means. FIG. 20 is a lower oblique view of device 199 of FIG. 17 showing one possible placement of tent fly cable 183. FIG. 21 is a side view of embodiment 199 shown in FIG. 17 showing the placement of the components on both sides of fabric 177.

In one preferred embodiment of the invention adapted and arranged to be used with a structure such as a tent or awning, the device includes two main components, one each disposed on opposite sides of a portion of a membrane of a structure, plus a means for operatively connecting the two components to one another. Thus, in one specific example, the inner (lighting) component is preferably disposed on the inside of the tent membrane and the outer (energy-gathering) component is preferably disposed on the outside of the tent membrane. Typically, either the inner component or the outer component may include a means for storing electrical power, such as a rechargeable battery.

In a significant aspect, the inner and outer components may be connected to one another in a number of different ways. One preferable means or method of connection is through the use of a compressible or flat conduit that can be temporarily or permanently attached to the tent fabric or membrane to thereby provide both a means for attaching the components in an operatively juxtaposed position, and a means for clearly designating one or more attachment points for the device on both sides of a membrane. The main outer (upper) and inner (lower) components can thereby be demountably attachable by means of such a conduit. As one of skill in the relevant art will recognize, there are many other different configurations and adaptations of conduits adapted for use with the various embodiments of the invention.

FIG. 22 shows a cross section through the center of typical upper and lower housings of typical embodiments of the invention, and depicts some salient elements of exemplary embodiments of the invention used to connect the main upper and lower components to disc receptacle 151 and disc 149 disposed across membrane 177. The elements are shown detached from one another with both inner and outer components separated from disc receptacles 149. FIG. 23 shows the same elements depicted in FIG. 22, but wherein the upper and lower housings are shown operatively attached to one another by means of disc receptacles 149 positioned to hold the components together through fabric membrane 177. FIG. 24 shows typical circuitry 205 suitable for operatively connecting embodiments of a device of the invention such as those shown in FIG. 17. FIG. 25 depicts a side cross-sectional view of a portion of tent 210 wherein a device such as that of FIG. 17 is shown operatively installed across the exterior membrane of a multi-layered tent, or other fabric-based shelter, and disposed outside of inner layer 212 of tent 210.

Preferably, a conduit adapted for use with the main housing components of the invention is of appropriate dimensions and configuration that it permits the tent (or fabric structure) to be rolled, folded or deflated without hindrance or obstruction while still being adapted to provide a water-tight or fluid-tight and operative connection between the two main components when they are affixed to at least one surface of the tent. In one preferred embodiment shown in FIGS. 20, 22, and 23, a conduit comprises two plastic discs 149 that have embedded receptacles 151 constructed and arranged to pass electrical current from the outer charging/battery component to the inner lighting component of the device.

The two discs 149 may be fastened to one another through the tent fabric 177 by any means which provides the desired seal across the membrane. For example, machine screws 153 (or similar metallic or non-metallic but conductive fasteners) may serve to hold the two discs 149 together as well as provide the electrical connection through the tent fabric. Additionally, the discs may be attached to the fabric by means of one or more appropriate adhesives. Thus, the discs are attached to one another, or attached to the synthetic or fabric membrane disposed therebetween.

In yet other embodiments, discs 149 may also comprise small metal plates 121 imbedded within discs 149. Metal plates 121 may be used to support, for example, rare earth magnets 123. Magnets 123 are embedded within the inner and outer main components and are used to position the components while attaching them in juxtaposition, and also may be constructed and arranged to assist in holding the components in place.

In other embodiments, a conduit according to the invention may be constructed and arranged so that it can be mounted across a rigid panel or membrane, such as a metallic roof panel, a metallic vehicle roof, a fiberglass panel, thin wood, or a glass panel or window. In embodiments adapted for disposition across metallic (or otherwise electrically conductive) materials, the conduit must provide an insulated electrical path for connecting the two main components. In embodiments positioned within In still other embodiments, the conduit may comprise upper and lower elements which are attached opposite one another across a membrane or panel, but do not physically touch one another. Such conduits would be useful across glass or fiberglass panels, for example, and could be adapted for transmitting electrical power between the respective upper and lower main components by, for example, magnetic induction.

According to the invention, the inner lighting component typically includes a light-producing source, for example, one or more Light Emitting Diode ("LED's"), halogen light bulbs or conventional incandescent light bulbs. In some embodiments, the light producing source produces light in ranges visible to human beings. In other preferred embodiments, the light-producing source produces light in one or more other desired ranges, such as the near-red, ultraviolet or infrared ranges, for example, which may be directed toward being useful for night-vision or military purposes. Devices of the invention are particularly useful in environments which receive a great deal of incident radiant energy during the daytime.

Thus, in one preferred embodiment, LED bulb 109 is housed in plastic compartment 163, is operatively connected to a switch 141, and is provided with transparent or translucent lens 137. A flat side of plastic compartment 163 is provided with an indentation 167 as is shown in FIG. 17, disposed for housing a connector assembly useful for connecting the component to the conduit. In one embodiment, the connector assembly includes two spring loaded clips 125 disposed to engage plastic discs 149 to hold the component in place as well as to provide the electrical connection between the bulb and the conduit. Clips 125 are operatively connected to arms 127 that protrude beyond the outer edge of the component. When these protrusions are pressed together, the clips release from the conduit and the component can be removed. Thus, the two main components of the invention may be constructed and arranged so that they can be reversibly attached and detached to one another through a large variety of membrane types such as are discussed herein, and through other membrane types as well.

FIG. 27 is a top oblique view of plastic discs 149 installed across the fabric of a tent 177 using machine screws 153 both as electrical conduits and as means of holding discs 149 and metal plates 121 in place across the fabric of tent 177 such that tent 177 can be rolled up or folded without difficulty. FIG. 28 is a top oblique view of embodiment 222 according to the invention adapted for use with a fabric structure comprising a transparent or semi-transparent section of membrane such as a glass or metallic sunroof in a tent or vehicle. FIG. 29 is a lower oblique exploded view of embodiment 222 shown in FIG. 28. FIG. 30 shows a device of the invention, such as that shown in FIGS. 28 and 29, disposed across the exterior of tent 210, wherein the tent is provided with a transparent or semi-transparent section such as a plastic or fabric sunroof. FIG. 31 is a diagram of circuit 215, one of many possible electrical circuits useful for operatively connecting the various components of the invention.

The outer battery component may be adapted to be housed in plastic compartment 165. In the embodiment shown in the Figures, the same spring loaded connector assembly can function to connect to the conduit. In the embodiment shown in FIGS. 17 and 19, the compartment also houses rechargeable batteries 115, circuit board 111, solar panel 101, which is operatively connected to charge the batteries, and light sensor 103 that can be adapted to ensure that the lamp only comes on during ambient darkness.

Another additional advantage of the present invention relates to its minimal requirements for operation. In order to effectively operate, the radiant energy gathering means need only be in an environment in which it is exposed to radiant energy of a wavelength or wavelengths appropriate for the type of energy collector being used. Thus, a device according to the invention can be adapted and arranged to operate in many different types of environments and configurations.

For example, a device of the invention can be used with various tent configurations. Thus, with reference to FIG. 26, if a tent fly 179 is used, then the outer component can be placed on the outside of the tent fly (or on another surface that is exposed to direct sunlight). In the configuration shown in FIG. 26, a cable 183 is used to connect the outer side of the conduit to the outer component. One end of the cable 185 connects to the outer side of the conduit and uses the same spring loaded connection as the inner and outer components. The other end of the cable 187 is functionally identical to the outside portion of the conduit thus allowing it to be connected to the outer component. It also has a spring loaded clip 189 to attach itself to the tent fly or other objects.

Another option when using a tent fly (or when the tent is not in direct sunlight) is to remove the outer component and place it in an area exposed to direct sunlight during daylight hours and replace the component on the conduit when it is dark. While the outer component is removed from the conduit the solar panel will continue to charge the batteries within it. The rare earth magnet 123 on the bottom of the outer housing component 165 also allows it to be easily mounted on any metal surface while it is charging.

FIG. 30 depicts another embodiment of a device wherein a metal ring 131 embedded in housing 169 is used to suspend the unit from the fabric membrane using a support ring containing a plurality of magnets 123. A series of auxiliary solar panels 119 are mounted on the sides of housing 169 in order to attract ambient and reflected light within the interior of the tent in order to augment the current being generated by the main solar panel 101 thus compensating for the reduced radiant light passing through the transparent or semi-transparent membrane.

As those of skill in the art will appreciate, numerous permutations of the invention are possible within the metes and bounds of the claims herein. As examples, numerous permutations and variations of such aspects of the invention as the means for gathering radiant energy, the means for converting the radiant energy into electrical power, the means for transmitting electrical power across the membrane, and the means for producing light of a desired frequency range are comprehended by the invention. Thus, although the present invention has been described with reference to the preferred embodiments, variations and modifications of elements and components of the invention can be substituted therefor, while remaining within the spirit and scope of the invention.

What is claimed is:

1. A device for providing illumination, comprising a) at least one means for gathering radiant energy, wherein said means for gathering radiant energy is constructed and arranged for receiving said radiant energy and is reversibly attachable on or adjacent to a first side of a membrane;

b) at least one means for converting said radiant energy into electrical power;

c) at least one means for transmitting said electrical power across said membrane; and d) at least one means for producing light of a desired frequency range from said electrical power;

wherein said means for producing light of a desired frequency range is constructed and arranged to be disposable on, adjacent to, or near a second side of said membrane, wherein said second side is disposed opposite said first side of said membrane, and wherein said means for transmitting said electrical power across said membrane is one or more selected from the group comprising magnetic inductors, electrical inductors, electrically conductive pins constructed and arranged for piercing said membrane and extending between said means for receiving solar energy and said means for producing light, and wiring means constructed and arranged for piercing said membrane and for extending between said means for receiving solar energy and said means for producing light.

2. The device of claim 1, wherein one or more of said means for gathering radiant energy, said means for transmitting said electrical power, and said means for producing light are constructed and arranged to be reversibly attachable onto or adjacent to said membrane, or onto or adjacent a structure to which said membrane is attached.

3. The device of claim 1, further comprising e) at least one means for storing said electrical power.

4. The device of claim 1, wherein said radiant energy is one or more of solar energy, reflected solar energy, any portion of the solar radiation spectrum, thermal energy, and radiant energy produced by artificial means.

5. The device of claim 1, wherein said means for converting said solar energy into electrical power is one or more solar panels, and wherein said solar panels comprise solar cells.

6. The device of claim 1, wherein said means for producing light of a desired frequency range from said electrical power is one or more selected from the group comprising incandescent light bulbs, light-emitting diodes (LED's), organic light-emitting diodes (OLED's), electro-luminescent devices and fluorescent devices.

7. The device of claim 1, wherein said means for gathering said radiant energy is one or more selected from the group comprising solar cells, lenses, reflectors, mirrors, prisms and combinations thereof.

8. The device of claim 1, wherein said means for storing said electrical energy is one or more selected from the group comprising batteries, rechargeable batteries, capacitors, other capacitive storage devices, electronic chips, NiCad Batteries, Nickel-Metal Hydride (NiMH) batteries, Lithium-ion (Li-ion) batteries Zinc-Air fuel cells and other types of fuel cells.

9. The device of claim 1, further comprising circuitry for controlling the supply of said electrical power to said means for producing light.

10. The device of claim 1, further comprising circuitry for controlling the supply of said electrical power to said means for storing said electrical energy.

11. The device of claim 1, wherein said membrane comprises one or more layers of fabric formed of natural fibers, one or more layers of fabric formed of synthetic fibers, one or more layers of fabric formed of a combination of synthetic and natural fibers, one or more layers of plastic sheeting, one or more layers of other synthetic materials, one or more layers of glass, one or more layers of metallic sheeting, one or more layers of wood, one or more layers of building materials, and one or more layers of roofing.

12. The device of claim 1, wherein said membrane comprises at least part of a structure, and wherein said structure is one or more of a tent, an umbrella, a shelter, a tarp, a canopy, an awning, a building, a window, a fabric or fiberglass vehicle portion, a vehicle roof, and other vehicle portions comprising metallic, natural or synthetic materials.

13. The device of claim 1, in combination with a portion of one or more of a tent, an umbrella, a shelter, a tarp, a canopy, an awning, a fabric or fiberglass vehicle portion, a vehicle roof, and other vehicle portions comprising metallic, natural or synthetic materials.

14. The device of claim 1, further comprising switch means operably connected to one or more of said means for gathering radiant energy, said means for producing light and said means for storing said electrical energy, wherein said switch means is constructed and arranged to activate and deactivate said one or more of said means for gathering radiant energy, said means for producing light and said means for storing said electrical energy.

15. The device of claim 4, wherein said switch means is constructed and arranged to be operated remotely.

16. The device of claim 4, wherein said switch means is constructed and arranged to he operated in conjunction with a radiant energy sensor, said sensor being associated with said device to optimize its functions.

17. The device of claim 1, wherein one or more of said means for gathering radiant energy, said means for producing light, said means for storing said electrical energy and said means for transmitting said electrical power across said membrane, are constructed and arranged such that said membrane is capable of being folded, rolled or otherwise manipulated without rendering said device inoperable.

18. The device of claim 1, wherein said device is attached to an umbrella, said umbrella is constructed and arranged to have a number of extended and folded configurations, and wherein said device or said umbrella further comprises a tilt switch, said tilt switch being constructed and arranged such that one or more of said means for gathering radiant energy, said means for transmitting said electrical power across said membrane, said means for producing light, and said means for storing said electrical energy are activated by one or more of said configurations.

19. The device of claim 8, wherein said device is disposed upon said umbrella such that said radiant energy reaches said device regardless of said one or more configurations.

20. The device of claim 1, wherein at least one first magnet is disposed on or in said means for gathering radiant energy and wherein at least one second magnet is disposed on or in said means for producing light, such that said first and second magnets are adapted and arranged to do one or more of i) operatively juxtaposing said means for gathering energy and said means for producing light across said membrane, ii) positioning said two means when affixing or removing the device from the sides of said membrane, and iii) securing said means for gathering energy to a surface comprising metal, said surface being located remotely from said means for producing light.

* * * * *